US010655631B2

(12) United States Patent
Schibli et al.

(10) Patent No.: US 10,655,631 B2
(45) Date of Patent: May 19, 2020

(54) PUMP HOUSING MADE FROM AT LEAST THREE DIFFERENT SINTERABLE MATERIALS

(71) Applicant: HERAEUS DEUTSCHLAND GMBH & CO. KG, Hanau (DE)

(72) Inventors: Stefan Schibli, Frankfurt (DE); Jörg-Martin Gebert, Karlsruhe (DE); Ulrich Hausch, Frankfurt (DE); Oliver Keitel, Aschaffenburg (DE)

(73) Assignee: Heraeus Deutschland GmbH & Co. KG, Hanau (DE)

( * ) Notice: Subject to any disclaimer, the term of this patent is extended or adjusted under 35 U.S.C. 154(b) by 730 days.

(21) Appl. No.: 15/128,921

(22) PCT Filed: Mar. 23, 2015

(86) PCT No.: PCT/EP2015/056137
§ 371 (c)(1),
(2) Date: Sep. 23, 2016

(87) PCT Pub. No.: WO2015/144643
PCT Pub. Date: Oct. 1, 2015

(65) Prior Publication Data

US 2017/0102001 A1 Apr. 13, 2017

(30) Foreign Application Priority Data

Mar. 24, 2014 (DE) ..... 10 2014 004 121

(51) Int. Cl.
*F04D 29/02* (2006.01)
*F04D 13/06* (2006.01)
(Continued)

(52) U.S. Cl.
CPC ..... *F04D 29/026* (2013.01); *F04D 13/064* (2013.01); *F04D 29/181* (2013.01);
(Continued)

(58) Field of Classification Search
CPC .... F04D 29/026; F04D 13/064; F04D 29/181; F04D 29/522; F04D 29/528;
(Continued)

(56) References Cited

U.S. PATENT DOCUMENTS 3,608,088 A 9/1971 Dorman et al.
3,932,069 A * 1/1976 Giardini ..... F04D 13/0666 417/420

(Continued)

FOREIGN PATENT DOCUMENTS

CN 1491323 4/2004
CN 1609455 4/2005

(Continued)

OTHER PUBLICATIONS

Molecular Weight of Aluminum Oxide. ConvertUnits.com [retrieved on Feb. 20, 2019]. Retrieved from the Internet: <URL: www.convertunits.com/molarmass/Aluminium+Oxide>. (Year: 2019).*

(Continued)

*Primary Examiner* — Christopher Verdier
*Assistant Examiner* — Juan G Flores
(74) *Attorney, Agent, or Firm* — Dicke, Billig & Czaja, PLLC

(57) ABSTRACT

One embodiment relates to a pump device with an impeller; a pump housing, including a wall surrounding an interior having an inlet and an outlet. The impeller is provided in the interior of the pump housing. The pump housing includes at least one first part-region, at least two further part-regions and at least one third part-region. The at least one first part-region includes, to an extent of at least 60% by weight, based on the total weight of the first part-region, at least one nonmagnetic material, wherein the at least two further part-regions comprise, to an extent of at least 25% by weight, based on the total weight of the further part-region,
(Continued)

at least one ferromagnetic material metal, wherein the at least one third part-region comprises a metal content in a range from 40% to 90% by weight, based on the total weight of the third part-region.

26 Claims, 7 Drawing Sheets

(51) Int. Cl.

| | |
|---|---|
| ***F04D 29/52*** | (2006.01) |
| ***F04D 29/18*** | (2006.01) |
| ***F04D 29/64*** | (2006.01) |
| *B28B 1/14* | (2006.01) |
| *B28B 1/16* | (2006.01) |

(52) U.S. Cl.
CPC ..... *F04D 29/522* (2013.01); *F04D 29/528* (2013.01); *F04D 29/648* (2013.01); *B28B 1/14* (2013.01); *B28B 1/16* (2013.01); *F05D 2230/20* (2013.01); *F05D 2230/40* (2013.01); *F05D 2300/10* (2013.01); *F05D 2300/17* (2013.01); *F05D 2300/20* (2013.01); *F05D 2300/507* (2013.01)

(58) Field of Classification Search
CPC ..... F04D 29/648; F04D 29/02; F04D 29/40; B28B 1/14; B28B 1/16; F05D 2230/20; F05D 2230/40; F05D 2300/10; F05D 2300/17; F05D 2300/20; F05D 2300/507
USPC ..... 415/182.1, 200
See application file for complete search history.

(56) References Cited

U.S. PATENT DOCUMENTS

| | | | | |
|---|---|---|---|---|
| 4,603,062 | A | 7/1986 | Ecer | |
| 4,806,080 | A | 2/1989 | Mizobuchi et al. | |
| 5,112,200 | A * | 5/1992 | Isaacson | F04D 13/0646 415/900 |
| 5,370,509 | A | 12/1994 | Golding et al. | |
| 5,470,208 | A | 11/1995 | Kletschka | |
| 5,641,276 | A * | 6/1997 | Heidelberg | H02K 1/2773 310/156.28 |
| 5,822,839 | A * | 10/1998 | Ghosh | H02K 5/167 29/596 |
| 5,840,070 | A * | 11/1998 | Wampler | F16C 39/063 604/131 |
| 5,990,588 | A * | 11/1999 | Kliman | H02K 3/493 310/86 |
| 6,048,363 | A | 4/2000 | Nagyszalanczy et al. | |
| 6,053,705 | A | 4/2000 | Schoeb et al. | |
| 6,058,593 | A * | 5/2000 | Siess | H02K 5/08 29/596 |
| 6,158,984 | A * | 12/2000 | Cao | F04D 29/026 415/200 |
| 6,227,817 | B1 | 5/2001 | Paden | |
| 6,234,772 | B1 | 5/2001 | Wampler et al. | |
| 6,499,209 | B1 * | 12/2002 | Landin | H02K 1/04 29/596 |
| 6,663,362 | B1 | 12/2003 | Lentz et al. | |
| 6,717,311 | B2 | 4/2004 | Locke | |
| 7,229,258 | B2 | 6/2007 | Wood et al. | |
| 8,007,254 | B2 | 8/2011 | LaRose et al. | |
| 8,641,594 | B2 * | 2/2014 | LaRose | A61M 1/101 600/16 |
| 8,821,365 | B2 | 9/2014 | Ozaki et al. | |
| 8,864,643 | B2 | 10/2014 | Reichenbach et al. | |
| 9,850,906 | B2 | 12/2017 | Ozaki et al. | |
| 2004/0062664 | A1 | 4/2004 | Weigold et al. | |
| 2005/0279847 | A1 | 12/2005 | Kim | |
| 2006/0127253 | A1 | 6/2006 | Ekberg et al. | |
| 2007/0156006 | A1 | 7/2007 | Smith et al. | |
| 2009/0022610 | A1 | 1/2009 | Materne et al. | |
| 2012/0029265 | A1 * | 2/2012 | LaRose | A61M 1/101 600/16 |
| 2012/0091832 | A1 * | 4/2012 | Soderberg | C08J 3/00 310/44 |
| 2012/0098371 | A1 | 4/2012 | Pinneo et al. | |
| 2013/0096364 | A1 * | 4/2013 | Reichenbach | A61F 2/07 600/16 |
| 2016/0369805 | A1 | 12/2016 | Keitel et al. | |
| 2016/0369813 | A1 | 12/2016 | Schibli et al. | |
| 2016/0369814 | A1 | 12/2016 | Schibli et al. | |

FOREIGN PATENT DOCUMENTS

| | | |
|---|---|---|
| CN | 102387881 | 3/2012 |
| DE | 29723409 | 10/1998 |
| DE | 29907332 | 10/1999 |
| DE | 19956380 | 1/2001 |
| DE | 10108810 | 8/2002 |
| DE | 102006008423 | 8/2007 |
| DE | 10164898 | 9/2010 |
| DE | 112011102347 | 5/2013 |
| DE | 112011102354 | 5/2013 |
| EP | 2236229 | 6/2010 |
| JP | 2010-279490 | 12/2010 |
| WO | 9811650 | 3/1998 |
| WO | 0064030 | 10/2000 |
| WO | 2010050114 | 5/2010 |
| WO | 2010119267 | 10/2010 |
| WO | 2012132850 | 10/2012 |
| WO | 2014202225 | 12/2014 |
| WO | 2014202226 | 12/2014 |
| WO | 2014202227 | 12/2014 |

OTHER PUBLICATIONS

Aluminum Oxide (Al2O3) Balls. RGPBALLS S.r.l. 2019 [retrieved on Mar. 14, 2019]. Retrieved from the Internet: <URL: www.rgpballs.com/en/aluminum-oxide-al2o3-balls/>. (Year: 2019).*

Ashby et al. Materials and Design: The Art and Science of Material Selection in Product Design, p. 218 [online], Second Edition. Elsevier 2002 [retrieved on Mar. 4, 2019]. Retrieved from the Internet: <URL: https://books.google.com/books?isbn=0080949401>. (Year: 2002).*

Magnetic Permeability. Dura Magnetics, Inc. Aug. 5, 2015 [retrieved on Mar. 25, 2019]. Retrieved from the Internet: <URL: https://www.duramag.com/techtalk/tech-briefs/magnetic-permeability-why-are-some-materials-attracted-by-a-magnet-and-others-are-not/>. (Year: 2015).*

Polyurethanes and Medical Applications. American Chemistry Council. 2005-2019 [retrieved on Mar. 26, 2019]. Retrieved from the Internet: <URL: https://polyurethane.americanchemistry.com/Polyurethanes-and-Medical-Applications/>. (Year: 2019).*

The International Preliminary Report on Patentability for International Application No. PCT/EP2015/056137 dated Oct. 6, 2016 (20 pgs).

The International Search Report and Written Opinion for International Application No. PCT/EP2015/056137 dated Sep. 2, 2015 (21 pgs).

Office Action dated Jan. 17, 2018 in parallel U.S. Appl. No. 14/900,509.

Final Office Action dated Aug. 27, 2018 in parallel U.S. Appl. No. 14/900,509.

Office Action dated Apr. 23, 2019 in parallel U.S. Appl. No. 14/900,509.

Office Action dated Jan. 17, 2018 in parallel U.S. Appl. No. 14/900,513.

Final Office Action dated Aug. 8, 2018 in parallel U.S. Appl. No. 14/900,513.

Office Action dated Dec. 20, 2018 in parallel U.S. Appl. No. 14/900,513.

Final Office Action dated May 30, 2019 in parallel U.S. Appl. No. 14/900,513.

(56) References Cited

OTHER PUBLICATIONS

Office Action dated Apr. 5, 2018 in parallel U.S. Appl. No. 14/900,515.
Final Office Action dated Nov. 10, 2018 in parallel U.S. Appl. No. 14/900,515.
Office Action dated Jun. 3, 2019 in parallel U.S. Appl. No. 14/900,515.
The Search Report for International Application No. PCT/EP2014/001684 dated Oct. 24, 2014 (2 pgs.).
The translation of the Written Opinion of the International Searching Authority for International Application No. PCT/EP2014/001684 dated Oct. 24, 2014 (6 pgs.).
The International Search Report and Written Opinion for International Application No. PCT/EP2014/001685 dated Oct. 24, 2010 (7 pgs.).
The International Search Report and Written Opinion for International Application No. PCT/EP2014/001686 dated Mar. 12, 2014 (13 pages).

* cited by examiner

PUMP HOUSING MADE FROM AT LEAST THREE DIFFERENT SINTERABLE MATERIALS

CROSS REFERENCE TO RELATED APPLICATION

This Utility Patent Application claims the benefit of the filing date of German Application No. DE 10 2014 004 121.2, filed Mar. 24, 2014, and International Application No. PCT/EP2015/056137, filed Mar. 23, 2015, both of which are herein incorporated by reference.

BACKGROUND

One embodiment relates to a pump device comprising i. an impeller; ii. a pump housing comprising a wall surrounding an interior having an inlet and an outlet, wherein the impeller is provided in the interior of the pump housing; wherein the pump housing comprises at least one first part-region, at least two further part-regions and at least one third part-region; wherein the at least one first part-region comprises, to an extent of at least 60% by weight, based on the total weight of the first part-region, at least one non-magnetic material, wherein the at least two further part-regions each comprise, to an extent of at least 25% by weight, based on the total weight of the respective further part-region, at least one ferromagnetic material, wherein the at least one third part-region comprises a metal content in a range from 40% to 90% by weight, based on the total weight of the third part-region, wherein the wall of the pump housing, in at least one plane (Q) perpendicular to the longitudinal extent of the pump housing, has at least one first part-region and at least two further part-regions, wherein the at least one first part-region and at least one of the at least two further part-regions are cohesively bonded to one another.

One embodiment also relates to a method for producing a pump housing, comprising the steps of: a. providing a first material; b. providing a further material; c. forming a third material; d. forming a pump housing precursor, wherein a first part-region of the pump housing is formed from the first material and wherein at least two further part-regions of the pump housing are formed from the further material; and e. treating the pump housing precursor at a temperature of at least 300° C. One embodiment further relates to a pump housing for a pump device obtainable by the method, and to a housing having at least three part-regions. One embodiment also relates to a pump device comprising the aforementioned housing or the aforementioned pump housing.

Pump devices having rotors or impellers are known. Some pump devices have, as conveying zone for a fluid to be conveyed, a pump housing in the form of a tube. An impeller which is often present therein is driven, for example, by a motor outside the conveying zone via a driveshaft. The pump housing is secured to the pump device by means of one or more holding elements. This manner of mounting may include various disadvantages. Firstly, an additional operating step is required to attach the mount. This increases production costs and is resource-inefficient. Moreover, the bonding between the pump housing and the mount is not without stress because of the production or because of the bonding means used, for example screws or rivets. This is because usually different materials are chosen for the mounts and/or bonding means than for the pump housing. These stresses result in deterioration of the bonds of the mount to the pump housing over time. Furthermore, it is extremely important for very small pumps in particular to be manufactured in an extremely space-saving manner. This is especially true of pumps which are to be implanted into a body. A space-saving construction is more difficult to achieve for pumps having a multitude of individual parts than in the case of a pump having a smaller number of individual parts.

In general terms, it is an object of the invention to at least partly overcome the disadvantages that arise from the prior art.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
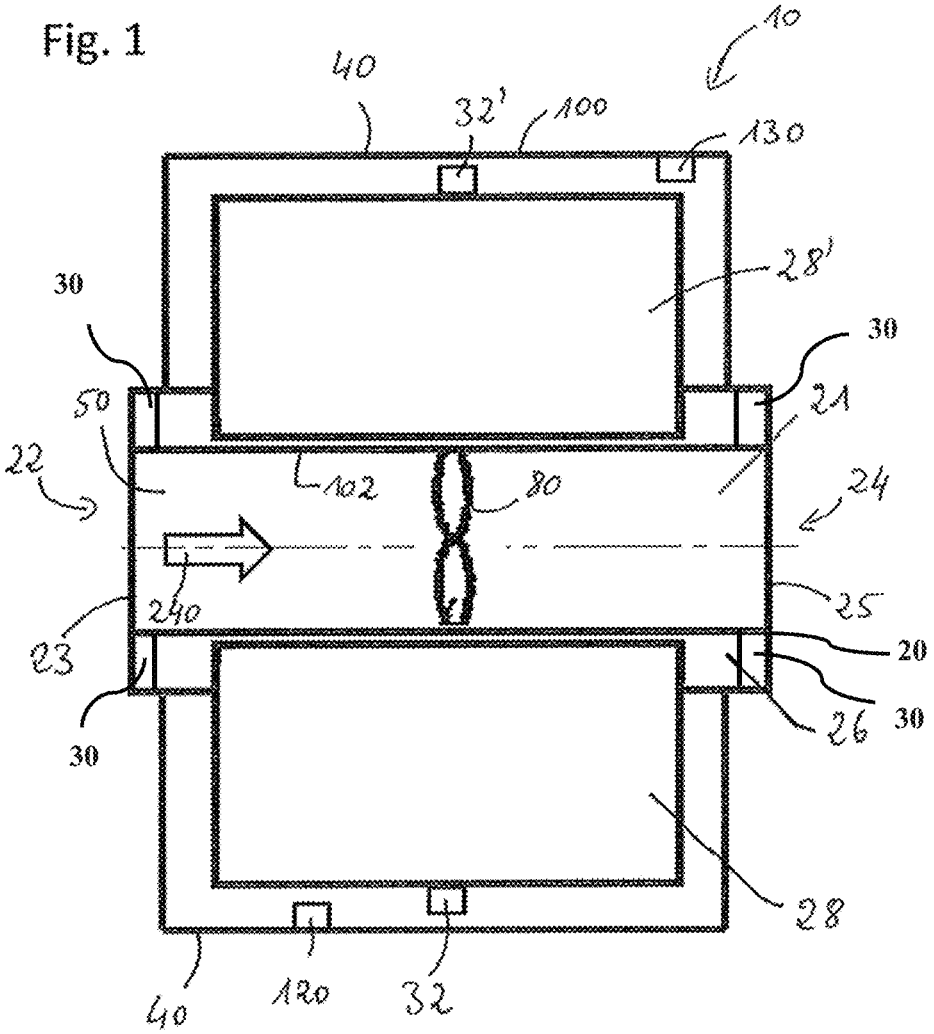
FIG. 1 is a schematic diagram of a pump device of one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

It is a further object to provide a pump device having materials that are as far as possbible biocompatible, readily processible, corrosion-resistant and bondable to one another in a permanent manner.

It is a further object to provide a pump device configured so as to occupy a minimum amount of space.

It is a further object to provide a pump device which can be operated in an energy-saving manner.

It is an additional object to provide an as far as possible stress-free pump device, especially with an as far as possible stress-free housing/pump housing, and especially an as far as possible stress-free transition from the pump housing to the remainder of the pump device.

It is yet an additional object to provide a pump device having minimum abrasion of the moving parts and mounts thereof in the course of use.

It is yet a further object to provide a pump housing for a pump device which can be integrated in a simple and space-saving manner into other components, for example a component housing of the pump device.

It is yet a further object to provide a pump housing for a pump device which can be hermetically bonded to a component housing of the pump device.

It is still a further object to provide a housing or pump housing which is as far as possible free of internal and/or external stresses.

It is still a further object to provide a method for producing a pump housing at minimum cost and taking a minimum amount of time.

It is still a further object to provide a component housing which occupies a minimum amount of space.

It is still a further object to provide a housing which can be hermetically bonded to other components.

A first subject matter of one embodiment is a pump device comprising:

i. an impeller;

ii. a pump housing comprising a wall surrounding an interior having an inlet and an outlet, wherein the impeller is provided in the interior of the pump housing;

wherein the pump housing comprises at least one first part-region, at least two further part-regions and at least one third part-region;

wherein the at least one first part-region comprises, to an extent of at least 60% by weight, preferably to an extent of at least 70% by weight, or preferably to an extent of at least 80% by weight, based on the total weight of the first part-region, at least one nonmagnetic material, wherein the at least two further part-regions each comprise, to an extent of at least 25% by weight, preferably to an extent of at least 40% by weight, or preferably to an extent of at least 60% by weight, based on the total weight of the respective further part-region, at least one ferromagnetic material, wherein the at least one third part-region comprises a metal content in a range from 40% to 90% by weight, preferably in a range from 50% to 85% by weight, or preferably in a range from 60% to 80% by weight, based on the total weight of the third part-region, wherein the wall of the pump housing, in at least one plane (Q) perpendicular to the longitudinal extent of the pump housing, has at least one first part-region and at least two further part-regions, wherein the at least one first part-region and at least one of the at least two further part-regions are cohesively bonded to one another.

The pump device of one embodiment is preferably suitable for introduction into the body of a human or animal. The pump device of one embodiment is further preferably designed to convey body fluids such as blood, serum, plasma, interstitial fluid, saliva or urine. It is especially preferable to introduce the pump device of one embodiment into the blood circulation of a human or animal for conveying of blood. The introduction of the pump device of one embodiment may involve, for example, implantation into the body, attachment to the body or connection to the body.

The pump housing of the pump device of one embodiment may have any shape that the person skilled in the art would select for use in a pump device. The pump housing preferably has at least one wall of the pump housing, also referred to hereinafter as pump housing wall. The at least one wall of the pump housing surrounds the interior of the pump housing. The pump housing has at least two ends, at least one inlet being arranged at one end and at least one outlet at the other end. The interior of the pump housing, apart from the inlet and outlet of the pump housing, is completely surrounded by the wall.

The side of the pump housing facing away from the interior is referred to as the outside of the pump housing. The pump housing preferably has an elongated shape. The pump housing is defined in terms of its shape by a longitudinal extent and at least one cross section. A cross section of the pump housing is always determined in a plane which is perpendicular to the pump housing wall. If the pump housing wall is curved in the longitudinal extent, a cross section is ascertained perpendicular to the tangent at a point on the pump housing wall. The longitudinal extent is regarded as the extent of the pump housing in pumping direction. It is always the shortest theoretical connection of inlet and outlet within the pump housing. The pump housing wall, also referred to as wall, extends in the direction of the longitudinal extent of the pump housing. The at least one wall may have one or more wall surfaces. If the pump housing has more than one wall surface, these are joined via corners where the wall surfaces meet. The wall, and preferably also the wall surfaces, of the pump housing preferably run parallel to the longitudinal extent of the pump housing.

If the pump housing has a tubular configuration, the inlet is at the first end and the outlet at the opposite end of the pump housing. Preferably at least part of the pump housing wall ends at the ends of the pump housing. The part of the pump housing which projects beyond the interior into the environment is also referred to as pump housing projection. In a preferred configuration of the pump device of one embodiment, the pump housing has, at the first end, the inlet, a first opening to the interior and, at the further end, the outlet, a further opening to the interior. The pump housing is connected to its environment in a fluid-conducting manner via the inlet and outlet. The openings at the ends of the pump housing enable a flow of a fluid through the interior of the pump housing. The fluid is, for example, a gas, a liquid such as blood, or a mixture of these. Preferably, the first opening serves as feed for the fluid to be conveyed into the interior of the pump housing and the further opening as drain for the fluid to be conveyed. The pump housing may have further openings, for example in the wall of the pump housing. These further openings may serve for additional feeding of fluid or, at the other end, for branched draining of fluid. If the pump device of one embodiment is implanted into a body, in order, for example, to promote blood circulation and hence reduce the burden on the heart, the pump device of one embodiment is connected to blood vessels of the body via conduits.

The pump housing comprises at least one first part-region, at least two further part-regions and at least one third part-region. The first part-region, the further part-regions and the third part-region preferably differ from one another by their composition. Further preferably, the at least one first part-region, the further part-regions and at least one third part-region differ in terms of shape.

The at least one first part-region preferably has at least one of, more preferably all of, the following properties:

- maximum thermal stability;
- maximum compressive strength;
- maximum hardness;
- maximum stability to acids and bases;
- minimum roughness;
- bondability with minimum stress to a metal-ceramic mixture (cermet);
- maximum sinterability with a metal or a metal-ceramic mixture (cermet);
- minimum electrical conductivity;
- minimum magnetic permeability.

The at least two further part-regions preferably have at least one of, preferably more than one of, more preferably all of, the following properties:

- maximum thermal stability;
- maximum compressive strength;
- maximum hardness;
- maximum stability to acids and bases;
- minimum roughness;
- maximum sinterability with a ceramic material or a metal-ceramic mixture (cermet);
- maximum electrical conductivity;
- maximum magnetic permeability.

The at least one third part-region preferably has at least one of, preferably more than one of, more preferably all of, the following properties:

- maximum thermal stability;
- maximum compressive strength;
- maximum hardness;
- maximum stability to acids and bases;
- minimum roughness;
- bondability with minimum stress to a metal-ceramic mixture (cermet);
- maximum sinterability with a ceramic or a metal-ceramic mixture (cermet);
- maximum bondability to a metal;
- maximum weldability to a metal;
- minimum magnetic permeability.

If the at least one first, the further part-regions and the at least one third part-region are combined in the course of production of the pump housing, a pump housing combining one or more of the properties listed for the at least one first part-region, the at least two further part-regions and the at least one third part-region is obtained. Preferably, at least part of the at least one first part-region is bonded to at least part of the further part-regions. Further preferably, at least part of the at least one first part-region is bonded to at least part of the at least one third part-region. The bond may be a direct bond of the respective part-regions or an indirect bond. The at least one first part-region and at least one of the at least two further part-regions are cohesively bonded to one another. Preferably, the at least one first and the at least one third part-region are cohesively bonded to one another. According to one embodiment, the at least one first part-region and at least one of the at least two further part-regions are cohesively bonded to one another.

A cohesive bond is present when the physical properties of one part-region, for example of the first part-region, give way in a fluid manner to the physical properties of another part-region, for example the further part-region or the third part-region. There is no sharp boundary between the two adjoining part-regions. Instead, there is a transition region in which the properties of the two adjoining part-regions are mixed. This transition region in the case of an indirect bond is also referred to as mixed part-region. In this mixed part-region, both the materials of one part-region, for example the first part-region, and, at least in part, the materials of the second part-region, for example of the further part-region or third part-region, are present alongside one another. The mixed part-region preferably constitutes a mixture of the materials and hence usually also of the properties of the two mixed part-regions. Preferably, the materials of the two part-regions enter into compounds or bonds at the atomic or molecular level. Forces act at the atomic or molecular level of the materials of the first and further or third part-regions. Such a cohesive connection can generally be parted only by destruction of the pump housing. Usually, cohesive bonds are achieved by sintering or by adhesive bonding of materials. Preferably, the cohesive bond is achieved by sintering.

The at least one first part-region comprises, to an extent of at least 60% by weight, preferably to an extent of at least 70% by weight, or preferably to an extent of at least 90% by weight, or preferably to an extent of 100% by weight, based on the total weight of the first part-region, a nonmagnetic material. This is preferably a nonmagnetic ceramic or a nonmagnetic metal. A nonmagnetic material is understood to mean a material having a magnetic permeability of less than 2μ. Such a material regularly does not have ferromagnetic properties. A ferromagnetic material is understood to mean a material having a magnetic permeability of more than 2μ.

Preferably, the at least one first part-region comprises the nonmagnetic ceramic in a range from 60% to 100% by weight, or preferably in a range from 70% to 100% by weight, or preferably in a range from 80% to 100% by weight, based on the total weight of the first part-region. Further preferably, the at least one first part-region comprises the nonmagnetic ceramic to an extent of 100% by weight, based on the total weight of the first part-region.

The nonmagnetic ceramic may be any ceramic that the person skilled in the art would select for the pump device of one embodiment. The ceramic is preferably selected from the group consisting of an oxide ceramic, a silicate ceramic, a non-oxide ceramic or a mixture of at least two of these.

The oxide ceramic is preferably selected from the group consisting of a metal oxide, a semimetal oxide or a mixture of these. The metal in the metal oxide may be selected from the group consisting of aluminum, beryllium, barium, calcium, magnesium, sodium, potassium, iron, zirconium, titanium or a mixture of at least two of these. The metal oxide is preferably selected from the group consisting of aluminum oxide ($Al_2O_3$), magnesium oxide (MgO), zirconium oxide ($ZrO_2$), yttrium oxide ($Y_2O_3$), aluminum titanate ($Al_2TiO_5$), a piezoceramic such as lead zirconate ($PbZrO_3$), lead titanate ($PbTiO_3$) and lead zirconate titanate (PZT) or a mixture of at least two of these. The semimetal in the semimetal oxide is preferably selected from the group consisting of boron, silicon, arsenic, tellurium or a mixture of at least two of these.

The silicate ceramic is preferably selected from the group consisting of a steatite ($Mg_3[Si_4O_{10}(OH)_2]$), cordierite ($(Mg,Fe^{2+})_2(Al_2Si)[Al_2Si_4O_{18}]$), mullite ($Al_2Al_{2+2x}Si_{2-2x}O_{10-x}$ with x=oxygen vacancies per unit cell), feldspar ($(Ba,Ca,Na,K,NH_4)(Al,B,Si)_4O_8$) or a mixture of at least two of these.

The non-oxide ceramic is preferably selected from the group consisting of a carbide, a nitride or a mixture of these. The carbide is preferably selected from the group consisting of silicon carbide (SiC), boron carbide ($B_4C$), titanium carbide (TiC), tungsten carbide, cementite ($Fe_3C$). The nitride is preferably selected from the group consisting of silicon nitride ($Si_3N_4$), aluminum nitride (AlN), titanium nitride (TiN), silicon aluminum oxynitride (SIALON) or a mixture of at least two of these.

The at least two further part-regions comprise, to an extent of at least 25% by weight, preferably to an extent of at least 30% by weight, preferably to an extent of at least 40% by weight, or preferably to an extent of at least 60% by weight, based on the total weight of the further part-regions, at least one ferromagnetic material. The ferromagnetic material is preferably distributed homogeneously in at least part of the at least two further part-regions.

Alternatively or additionally, at least one further part-region of the at least two further part-regions may have at least one first sub-region and at least one second sub-region. The at least one first sub-region and the at least one second sub-region preferably comprise the ferromagnetic material in different amounts. Preferably, multiple first and second sub-regions are provided in alternation. The first sub-regions comprise a lower content of ferromagnetic material than the second sub-regions. Preferably, the first and second sub-regions having a different content of ferromagnetic material are arranged in the form of layers in at least one of the at least two further part-regions. Preferably, within the at least one further part-region, there are at least two sub-regions, or preferably at least three or more sub-regions, or preferably at least five or more sub-regions, having a different content of ferromagnetic material in alternation. Further preferably, first and second sub-regions alternate layer by layer. Preferably, at least one of the at least two part-regions comprises the at least one first sub-region in a number in a range from 5 to 100, or preferably in a range from 10 to 80, or preferably in a range from 15 to 60. Further preferably, at least one of the at least two part-regions comprises the at least one second sub-region in a number in a range from 5 to 100, or preferably in a range from 10 to 80, or preferably in a range from 15 to 60. The at least one first sub-region comprising more of the ferromagnetic material than the at least one second sub-region preferably comprises the ferromagnetic material to an extent of at least 50% by weight, or preferably in a range from 60% to 100% by weight, or preferably in a range from 70% to 95% by weight, or preferably in a range from 75% to 90% by weight, based on the total weight of the first sub-region. The at least one second sub-region, having less ferromagnetic material, comprises the ferromagnetic material preferably in a range from 0% to 40% by weight, or preferably in a range from 0% to 30% by weight, or preferably in a range from 0% to 20% by weight, based on the total weight of the second sub-region. Further preferably, the resistance between two adjacent first sub-regions, formed by a second sub-region in between, is more than 1000 Ohm, or preferably more than 10000 Ohm, or preferably more than 100000 Ohm. The resistance between two adjacent first sub-regions can be determined as the volume resistance. In this case, the two first sub-regions that are in contact are not in direct contact with one another. They are separated by a second sub-region.

In addition, the sub-regions comprising more or less ferromagnetic material preferably further comprise a ceramic material. Suitable ceramic material is the same as described for the first part-region. The at least 25% by weight of ferromagnetic material in the at least two further part-regions is calculated for every further part-region by averaging the content in the first sub-regions and the content in the second sub-regions of ferromagnetic material. The at least two further part-regions, on average, comprise the ferromagnetic material in a range from 25 to 100% by weight, or preferably in a range from 40 to 95% by weight, or preferably in a range from 60 to 90% by weight, based on the total weight of the respective further part-region. The second sub-region, in a preferred configuration of the pump device, is in direct contact with the first sub-region. Preferably, the second sub-region is in contact with a first sub-region with at least 20% of the surface area, preferably with at least 40%, or preferably with at least 60% of the respective sub-region.

Further preferably, the at least one first sub-region and the at least one second sub-region are configured in the form of layers. The thickness of the layers is preferably in a range from 1 to 1000 μm, or preferably in a range from 10 to 500 μm, or preferably in a range from 50 to 250 μm. The at least one first sub-region and the at least one second sub-region preferably have two surfaces running parallel to one another. Preferably, at least one of the surfaces of the first sub-region is in contact with at least one surface of the second sub-region. This surface is also referred to as contact area. Preferably, the second sub-region is in contact with a first sub-region with at least 50%, preferably with at least 60%, or preferably with at least 70% of the respective contact area of the respective sub-region.

The at least one third part-region comprises a metal content in a range from 40% to 90% by weight, preferably in a range from 45% to 85% by weight, or preferably in a range from 50% to 80% by weight, based on the total weight of the third part-region.

The at least one first part-region, the at least two further part-regions and the at least one third part-region may be arranged in different ways within the pump housing. Preferably, there is no direct contact between the at least one third part-region and the at least two further part-regions. Preferably, the at least one third part-region and the at least two further part-regions are separated from one another by at least one first part-region. Further preferably, one third part-region is arranged at the inlet and one at the outlet of the pump housing of the pump device.

Preferably, the housing takes the form of a tube having a straight inner wall. Protuberances may protrude from the outer wall of the housing, which are formed either from at least one of the at least one first part-regions or from at least one of the at least two further part-regions or from a combination of the two types of part-regions. Examples of the arrangement of the various part-regions in cross section including the protuberances are shown in FIGS. 3*a*, 3*b*, 3*c*, 4*a* and 4*b*.

Every transition from a part-region to another part-region can be made along a straight or curved line. Alternatively or additionally, the transition from one part-region to another part-region can be made in an irregular manner, for example in the form of one or more steps or of a zigzag line.

Preferably, at least one surface of the at least one first part-region points towards the interior of the pump housing. In addition, at least one surface of the at least one third part-region points towards the interior of the pump housing. The at least one first part-region, the at least two further part-regions or the at least one third part-region may each form the entire wall thickness in a cross section in the plane of the pump housing at at least one position along the longitudinal extent of the pump housing. Alternatively, part of the wall thickness may comprise the first part-region and the other part of this wall thickness may comprise at least one further part-region or at least one third part-region. Preferably, the at least one first part-region and the at least two further part-regions and the at least one third part-region are configured as sections perpendicular or parallel to the longitudinal extent of the pump housing.

In a preferred configuration of the pump housing of the pump device of one embodiment, the at least one first part-region completely surrounds at least one of the at least two further part-regions. Preferably, the at least one first part-region completely surrounds all the at least two further part-regions. In a preferred configuration of the pump housing of the pump device of one embodiment, at least one surface of the first part-region points towards the outside of the pump housing.

In a further preferred configuration of the pump housing of the pump device of one embodiment, at least one surface of the at least one first part-region and at least one surface of at least one of the further part-regions points towards the outside of the pump housing.

Further preferably, at least one surface of the at least one third part-region points towards the inside of the pump housing. Preferably, at least one surface of the at least one third part-region points towards the outside of the pump housing.

In a further preferred configuration of the pump housing of the pump device of one embodiment, at least the at least two further part-regions point away from the preferably cylindrical base body of the pump housing in the form of protuberances in various spatial directions. Further preferably, the protuberances are arranged in a star shape around the base body of the pump housing.

The pump device of one embodiment additionally comprises a rotor in the form of the impeller. The impeller may have any shape that the person skilled in the art would select for this purpose.

The impeller preferably has a diameter in a range from 1 mm to 10 cm, preferably in a range from 3 mm to 5 cm, or preferably in a range from 5 mm to 3 cm. The impeller preferably has a thickness in a range from 0.1 to 50 mm, preferably in a range from 0.5 to 20 mm, or preferably in a range from 1 to 15 mm. The diameter of the impeller is preferably less than the diameter of the pump housing in the plane of the impeller. The diameter of the impeller is preferably in a range from 1% to 10%, or preferably in a range from 1.5% to 8%, or preferably in a range from 2% to 7%, based on the diameter of the pump housing in the plane of the impeller, less than the diameter of the pump housing.

The impeller preferably has at least two rotor blades, preferably at least three rotor blades, or preferably at least five rotor blades. More preferably, the impeller has a number of rotor blades in a range from 2 to 20, preferably in a range from 5 to 15, or preferably in a range from 8 to 13. The impeller preferably has a central axis about which the impeller can be rotated. The axis is also referred to as axis of rotation. The at least two rotor blades are preferably arranged symmetrically around the axis of the impeller. The impeller is preferably arranged in the interior of the pump housing, with the axis of rotation of the impeller parallel to the longitudinal extent of the wall of the tube.

The impeller may be manufactured from any material that the person skilled in the art would select for use in the pump device of one embodiment.

The impeller comprises at least one element, said element having hard magnetic properties. A hard magnetic property means that a material receives permanent magnetization after this material has been subjected to a magnetic field. After the magnetic field has dropped away, the magnetization of the hard magnetic material persists. Materials having hard magnetic properties can be used as permanent magnets. The at least one element is preferably arranged on the impeller such that the impeller is moved when the at least one element is alternately attracted or repelled by two mutually independent electrical or magnetic fields. The impeller preferably comprises at least two elements having hard magnetic properties. In addition, at least one optional element can control the impeller in its radial or also axial alignment. Preferably, the elements having hard magnetic properties are utilized for mounting of the impeller with minimum contact in the pump housing without further aids such as bearings or other fixings. This enables particularly low-friction and particularly low-wear operation.

The at least one element can be implemented, for example, by means of at least one rotor blade comprising a hard magnetic material. Alternatively, a hard magnetic element may be arranged on at least one rotor blade. Preferably, the hard magnetic element is provided in the core of the impeller. The at least one hard magnetic element preferably comprises at least one magnetizable material, for example a material selected from the group consisting of iron, cobalt, nickel, chromium dioxide or a mixture of at least two of these. The at least one element may be arranged, for example, in the form of a coating of hard magnetic material on at least one rotor blade or within the impeller. Preferably at least 50%, or preferably at least 70%, or preferably 100%, of the rotor blades comprise a hard magnetic material. Preferably, the element comprises, to an extent of at least 10% by weight, or preferably to an extent of at least 20% by weight, or preferably to an extent of at least 30% by weight, based on the total weight of the element, a hard magnetic metal. Further preferably, the element comprises a cobalt-chromium alloy or a platinum-cobalt alloy, especially a platinum-cobalt alloy (PtCo23) having a proportion of cobalt of 23% by weight based on the total weight of the alloy, in a range from 10% to 100% by weight, or preferably in a range from 20% to 100% by weight, or preferably in a range from 30% to 100% by weight, based on the total weight of the element.

Further preferably, the impeller may be coated on its outside, especially on the outer surface of the rotor blades, with a biocompatible material. Suitable biocompatible materials are described hereinafter.

The impeller is preferably arranged in the interior of the pump housing, which is preferably surrounded by the first part-region. The impeller is preferably arranged with its axis of rotation parallel to the longitudinal extent of the wall. In addition, the impeller can be aligned within the pump housing by a magnetic field.

In a preferred configuration of the pump device of one embodiment, the at least one third part-region comprises, to an extent of at least 60% by weight, preferably to an extent of at least 70% by weight, or preferably to an extent of at least 80% by weight, based on the total weight of the third part-region, at least one nonmagnetic material. Preferably, the nonmagnetic material comprises a nonmagnetic metal.

In a preferred configuration of the pump device of one embodiment, the nonmagnetic metal of the third part-region is selected from the group consisting of platinum (Pt), palladium (Pd), stainless steel (AISI 304, AISI 316 L), iridium (Ir), niobium (Nb), molybdenum (Mo), tungsten (W), titanium (Ti), chromium (Cr), tantalum (Ta) and zirconium (Zr) or a mixture of at least two of these. Preferably, the metal is selected from the group consisting of titanium, niobium, molybdenum, cobalt, chromium, tantalum and alloys thereof or a mixture of at least two of these.

In addition, the at least one third part-region may include further materials. The further material may be selected from the group consisting of a ceramic, a cermet or a mixture thereof.

The ceramic of the third part-region may be any ceramic that the person skilled in the art would select for a pump device. The ceramic is preferably selected from the group consisting of an oxide ceramic, a silicate ceramic, a non-oxide ceramic or a mixture of at least two of these. The ceramic of the at least one third part-region may be selected from the same group as the ceramics listed for the first part-region. Preferably, the at least one third part-region comprises the same ceramic as the at least one first part-region. The at least one third part-region comprises the ceramic preferably in a range from 1% to 60% by weight, or preferably in a range from 5% to 55% by weight, or preferably in a range from 10% to 45% by weight, based on the total weight of the third part-region. The sum of all the constituents of the at least one third part-region is always 100% by weight.

A selection in respect of the ceramic constituents and metallic constituents of the cermet may be composed of those which are specified for the at least one first part-region or the at least two further part-regions.

In a preferred configuration of the pump device, the at least one third part-region comprises a metal content at least 5% by weight, preferably at least 7% by weight, or preferably at least 10% by weight, more than that of the at least one first part-region, based on the total weight of the first part-region.

In a further preferred configuration of the pump device, the pump housing comprises at least 10% by weight, preferably at least 15% by weight, or preferably at least 20% by weight, based on the total weight of the pump housing, more of the at least one first part-region than of the at least one third part-region.

In a further preferred configuration of the pump device, the pump housing comprises a first part-region, at least two further part-regions and two third part-regions. The two third part-regions extend preferably over the entire thickness of the pump housing wall. Preferably, the two third part-regions are arranged at the inlet and the outlet.

The at least one first part-region preferably has a width, based on the longitudinal extent of the pump housing, in a range from 1 to 100 mm, preferably in a range from 2 to 70 mm, or preferably in a range from 3 to 50 mm.

The at least one third part-region preferably has a width, based on the longitudinal extent of the pump housing, in a range from 0.25 to 80 mm, preferably in a range from 0.5 to 60 mm, or preferably in a range from 1 to 40 mm.

In a preferred configuration of the pump device of one embodiment, the pump housing comprises at least one tube. The tube is preferably straight. Alternatively, the tube may have at least one bend. The tube is preferably closed, apart from at the inlet and the outlet. This means that the tube, except for the two openings at the inlet and outlet, preferably has no further openings. The dimensions, materials and configurations preferably correspond otherwise to those of the above-described pump housing.

In a preferred embodiment of the pump device of one embodiment, at least one third part-region is provided at the inlet or the outlet. Further preferably, one third part-region is provided at the inlet and one at the outlet. Further preferably, the pump housing comprises, at each of its two ends, a third part-region of equal size. These are preferably connected to one another via at least one first part-region. Preferably, the two third part-regions have a width in a range from 1 to 10 mm, or preferably in a range from 2 to 8 mm, or preferably in a range from 2.5 to 6 mm. Further preferably, one first part-region has a width of 5 to 40 mm, preferably in a range from 10 to 30 mm, or preferably in a range from 15 to 25 mm.

Preferably, the pump housing has, at the inlet and/or outlet, at least one different internal diameter compared to the internal diameter of rest of the pump housing. The different internal diameters can be achieved either via different wall thicknesses or via different arrangement or geometry of the third part-regions in relation to the at least one first part-region. The pump housing comprises at least one cross section which is preferably selected from the group consisting of circular, rectangular, polygonal or ellipsoidal. Preferably, the pump housing has an elongated shape at least in a first section. In addition, the pump housing may comprise at least one further section of differing shape from the first section of the pump housing.

Preferably, the total length of the pump housing is 1.5 to 10 times, preferably 2 to 9 times, or preferably 2.5 to 8.5 times longer than the diameter of the pump housing. The length of the pump housing is determined along the outer wall of the pump housing in pumping direction. The pump housing preferably has a length in a range from 1 mm to 10 cm, or preferably in a range from 2 mm to 8 cm, or preferably in a range from 5 mm to 5 cm. The pump housing preferably has an internal diameter in a range from 0.1 to 50 mm, or preferably in a range from 0.5 to 30 mm, or preferably in a range from 1 to 20 mm.

In a preferred configuration of the pump device of one embodiment, the pump housing has a volume in a range from 0.1 $cm^3$ to 10 $cm^3$, preferably in a range from 0.2 to 9 $cm^3$, or preferably in a range from 0.5 to 5 $cm^3$. The volume of the pump housing is defined by the inner space surrounded by the pump housing.

The wall of the pump housing preferably has a thickness in a range from 0.1 to 10 mm, or preferably in a range from 0.3 to 8 mm, or preferably in a range from 0.4 to 6 mm. On the inner surface of the pump housing, the wall thicknesses may vary in at least one of the first, further or third part-regions. An increase in the wall thickness at at least one point in the pump housing may serve to keep the impeller in its position in the pump housing at least in one direction.

The wall, especially the at least one wall surface of the pump housing, is preferably smooth. "Smooth" means that the wall of the pump housing has a roughness in a range from 0.025 to 4 Ra, or preferably in a range from 0.05 to 3 Ra, or preferably in a range from 0.07 to 1 Ra. The method of determining roughness is described in the test methods and is specified in DIN EN ISO 4288.

In a preferred configuration of the pump device of one embodiment, at least part of each further part-region each is surrounded by at least one electrical coil each.

The impeller in the interior of the pump housing is preferably aligned by magnetic fields from the electrical coils on the outside of the pump housing. The coils preferably comprise an electrically conductive material. Preferably, the electrically conductive material of the coils is selected from the group consisting of iron (Fe), copper (Cu), gold (Au), silver (Ag), platinum (Pt), palladium (Pd), titanium (Ti), chromium (Cr), cobalt (Co), tungsten (W) or a mixture of at least two of these. Further preferably, the electrically conductive material comprises copper (Cu). The pump device of one embodiment preferably comprises at least two coils, preferably at least three coils, or preferably at least four coils. The coils are preferably arranged on the outside of the pump housing, with the coils and the impeller preferably lying in one plane. In that case, they are arranged on the outside of the pump housing around the impeller.

In a preferred configuration of the pump device of one embodiment, the nonmagnetic material of the at least one first part-region is selected from the group consisting of a cermet, aluminum oxide ($Al_2O_3$), zirconium dioxide ($ZrO_2$), a zirconium oxide containing an aluminum oxide (ATZ), an aluminum oxide containing a zirconium oxide (ZTA), an yttrium-containing zirconium oxide (Y-TZP), aluminum nitride (AlN), magnesium oxide (MgO), a piezoceramic, barium (Zr, Ti) oxide, barium (Ce, Ti) oxide and sodium potassium niobate, a platinum alloy, a palladium alloy, a titanium alloy, a niobium alloy, a tantalum alloy, a molybdenum alloy, a stainless steel (AISI 304, AISI 316 L) or a mixture of at least two of these. The sum total of all constituents of the at least one first part-region is always 100% by weight.

In the context of one embodiment, "cermet" refers to a composite material composed of one or more ceramic materials in at least one metallic matrix or a composite material composed of one or more metallic materials in at least one ceramic matrix. For production of a cermet, it is possible to use, for example, a mixture of at least one ceramic powder and at least one metallic powder, which can be admixed, for example, with at least one binder and optionally at least one solvent. A selection in respect of the ceramic constituents and metallic constituents of the cermet may be assembled from those specified for the first part-region. A nonmagnetic cermet is a composite material composed of a nonmagnetic ceramic and a nonmagnetic metal, as will be mentioned later. In the cermet, the metal is preferably still in the form of a metallic component and can preferably be detected as such. Because of this metallic component, a cermet generally has a higher electrical conductivity than the pure ceramics.

In a preferred configuration of the pump device of one embodiment, the at least one first part-region comprises a nonmagnetic metal in a range from 40 to 90% by weight, preferably in a range from 50 to 90% by weight, or preferably from 60 to 90% by weight, based on the total weight of the at least one first part-region.

In a further preferred configuration of the pump device of one embodiment, the nonmagnetic metal is selected from the group consisting of platinum (Pt), palladium (Pd), iridium (Ir), niobium (Nb), molybdenum (Mo), tungsten (W), titanium (Ti), chromium (Cr), tantalum (Ta), zirconium (Zr), alloys of the aforementioned metals, gold (Au), nonmagnetic stainless steel (e.g. AISI 304, AISI 316 L) or a mixture of at least two of these. The nonmagnetic metal may preferably be selected from the group consisting of titanium (Ti), platinum (Pt), tantalum (Ta), niobium (Nb) or a mixture of at least two of these.

If the content of the nonmagnetic metal for the at least one first part-region is below 60% by weight of the first part-regions, the further nonmagnetic material may preferably be supplemented by a nonmagnetic ceramic or a nonmagnetic cermet, as described above, to at least 60% by weight of nonmagnetic material, based on the total weight of the first part-region.

In a preferred configuration of the pump device of one embodiment, the ferromagnetic material of the at least two further part-regions is selected from the group consisting of iron (Fe), cobalt (Co), nickel (Ni), chromium dioxide ($CrO_2$), an iron alloy, an iron-nickel alloy, an iron-silicon alloy, an iron-cobalt alloy, a nickel alloy, an aluminum-nickel alloy, a cobalt alloy, a cobalt-platinum alloy, a cobalt-chromium alloy, a neodymium-iron-boron alloy, a samarium-cobalt alloy or a mixture of at least two of these.

The at least two further part-regions of the pump housing preferably comprise a metal content in a range from 25% to 90% by weight, preferably in a range from 40% to 85% by weight, or preferably in a range from 50% to 80% by weight, based on the total weight of the respective further part-region.

In a preferred configuration of the pump device of one embodiment, at least one of the at least two further part-regions further comprises a component selected from a ceramic, a metal or a mixture of these. The ceramic is preferably selected from the group of the ceramics specified for the first part-region. Preferably, at least one of the at least two part-regions comprises the same ceramic as the first part-region. The at least two further part-regions comprise the ceramic preferably in a range from 1% to 75% by weight, or preferably in a range from 2% to 70% by weight, or preferably in a range from 5% to 60% by weight, based on the total weight of the respective further part-region. The further metal may comprise a metal having no ferromagnetic properties. These are preferably the metals which have also been specified for the first or the third part-region. The sum total of all the constituents of the further part-region is always 100% by weight.

In a preferred configuration of the pump device of one embodiment, the further metal is at least one of the at least two further part-regions selected from the group consisting of platinum (Pt), palladium (Pd), iridium (Ir), niobium (Nb), molybdenum (Mo), tungsten (W), titanium (Ti), chromium (Cr), a cobalt-chromium alloy, tantalum (Ta) and zirconium (Zr) or a mixture of at least two of these.

In a preferred configuration of the pump device of one embodiment, the at least one first part-region comprises less than 10% by weight, preferably less than 8% by weight, or preferably less than 5% by weight, of metal, based on the total weight of the first part-region.

In a further preferred configuration of the pump device, the at least one first part-region and/or at least one of the at least two further part-regions is cohesively bonded to at least one third part-region. Preferably, at least one first part-region is cohesively bonded to two further part-regions. Further preferably, at least one first part-region is cohesively bonded to all further part-regions. In addition, it is preferable that the at least one first part-region is cohesively bonded to at least one third part-region. Preferably, the at least one first part-region is cohesively bonded to two, or preferably to all, third part-regions.

In a preferred configuration of the pump device of one embodiment, the pump device is surrounded at least partly by a component housing, wherein at least part of the at least one third part-region of the pump device is preferably bonded to the component housing. The bond of the component housing to at least part of the third part-region of the pump housing preferably leads to an enclosed space between the component housing and the pump housing. Preferably, the interior of the component housing of the pump device is hermetically sealed off from the environment.

The pump device of one embodiment may especially be inserted into a body of a human or animal user, especially of a patient. A pump device used is generally exposed to a fluid of a body tissue of the body. It is thus generally important that no body fluid penetrates into the medically implantable device, nor that liquids escape from the medically implantable device. In order to ensure this, the component housing of the medically implantable device, and hence also the component housing and the pump housing of the pump device of one embodiment, should have maximum impermeability, particularly with respect to body fluids.

The pump device of one embodiment, especially the bond of component housing to pump housing, is preferably hermetically sealed. Thus, the inside of the pump device is hermetically sealed from the outside. In the context of one embodiment, the term "hermetic" means that no moisture and/or gases can penetrate the hermetic bond in the course of proper use over a typical period of 5 years. A physical parameter for determining the integrity of a bond or a component is the leak rate. Integrities can be determined by leak tests. Corresponding leak tests are conducted with helium leak testers and/or mass spectrometers and are specified in standard Mil-STD-883G Method 1014. The maximum permissible helium leak rate is fixed as a function of the internal volume of the device to be tested. According to the methods specified in MIL-STD-883G, Method 1014, in paragraph 3.1, and taking account of the volumes and cavities of the devices to be tested that occur in the application of one embodiment, the maximum permissible helium leak rate for the pump housing of one embodiment is $10^{-7}$ atm*cm$^3$/sec. This means that the device to be tested (for example the component housing and/or the pump device of one embodiment or the component housing with the associated pump housing) has a helium leak rate of less than $1\times10^{-7}$ atm*cm$^3$/sec. In a particularly advantageous execution, the helium leak rate is less than $1\times10^{-8}$ atm*cm$^3$/sec, especially less than $1\times10^{-9}$ atm*cm$^3$/sec. For the purpose of standardization, the helium leak rates mentioned can also be converted to the equivalent standard air leak rate. The definition of the equivalent standard air leak rate and the conversion are specified in standard ISO 3530. Air leak rate=0.37 times helium leak rate.

The pump device of one embodiment preferably has, as well as the impeller, the pump housing having at least one first part-region, at least two further part-regions and at least one third part-region, preferably a component housing in which further components of the pump device may bepresent. The further components of the pump device are preferably selected from the group consisting of a battery, a coil, a control unit, a vessel connection unit or a combination of at least two of these.

In a preferred configuration of the pump device of one embodiment, the component housing comprises titanium to an extent of at least 30% by weight, preferably at least 50% by weight, or preferably at least 80% by weight, based in each case on the total weight of the component housing. Further preferably, the component housing comprises titanium to an extent of at least 99% by weight, based on the total weight of the component housing. In addition, the component housing may preferably comprise at least one other metal. The other metal may be selected from the same group as the metal of the further part-region. The other metal is preferably selected from the group consisting of Fe, Al, V, Sn, Co, Cr, CoCr, Nb, stainless steel, Mb, TiNb or a mixture of at least two of these. The component housing may comprise the further metal preferably in a range from 1% to 70% by weight, or preferably in a range from 5% to 50% by weight, or preferably in a range from 10% to 20% by weight. The sum total of all constituents of the component housing is always 100% by weight. Suitable titanium qualities are specified in ASTM B265-05, 2011, for example grades 1 to 6.

In a preferred configuration of the pump device of one embodiment, the wall of the pump housing has a magnetic permeability of less than 2μ, preferably less than 1.9μ, or preferably less than 1.8μ. The magnetic permeability is determined in accordance with standard ASTM 773, 2009, variant 01.

In a preferred configuration of the pump device of one embodiment, one surface of the wall facing the interior of the pump housing has a Vickers hardness of at least 330 HV, preferably at least 350 HV, or preferably at least 370 HV. Preferably, the entire wall has a hardness in the ranges specified. At least the surface of the at least one first and the at least one third part-region likewise have a Vickers hardness of at least 330 HV, preferably at least 350 HV, or preferably at least 370 HV. Often, the hardness is not higher than 2000 HV, or preferably not higher than 1500 HV. Preferably, the hardness at least of the surface of the at least one first part-region is in a range from 330 to 2000 HV, or preferably in a range from 350 to 1800 HV. Further preferably, at least the surface of the at least one first part-region has a hardness at least as high as the hardness of the rotor surfaces of the impeller. See test methods (DIN ISO 6507 from March 2006, test force: 1 kg; contact time: 15 sec; test temperature: 23° C.+/−1° C.)

Preferably, at least the surface of the at least one first part-region has a hardness at least 20 HV, or preferably at least 30 HV, or preferably at least 40 HV, higher than the Vickers hardness of the rotor surfaces of the impeller. The surface of the at least one part-region, of the at least one further part-region and of the impeller is understood to mean the near-surface material layer in a range from 0.01 to 2.5 mm, preferably in a range from 0.05 to 1.0 mm, or preferably in a range from 0.1 to 0.5 mm, in each case perpendicular to the surface. Further preferably, at least the surface of the at least one third part-region has a hardness at least 20 HV, or preferably at least 30 HV, or preferably at least 40 HV, higher than the Vickers hardness of the rotor surfaces of the impeller. If part of a further part-region points towards the interior of the pump housing, preferably at least the surface of this at least one further part-region has a hardness at least 20 HV, or preferably at least 30 HV, or preferably at least 40 HV, higher than the Vickers hardness of the rotor surfaces of the impeller.

In a preferred configuration of the pump device of one embodiment, at least the outer surfaces of the component housing and the surface facing the interior of the pump housing are biocompatible. This is especially preferable when the pump device for implantation into a living body, for example that of a human or animal. Biocompatibility is ascertained and assessed in accordance with standard ISO 10993: 2002, Part 4.

In general, the surfaces facing the interior of the pump housing and the outer surfaces of the component housing, after implantation of the pump device of one embodiment into a living body, are in contact with the body fluid therein. The biocompatibility of the surfaces that come into contact with body fluid is a contributory factor to the body experiencing no damage on contact with these surfaces.

Useful biocompatible materials include all the ceramics mentioned for the first part-region. A material is biocompatible if it meets the demands of standard 10993-4:2002, as mentioned in the test methods for biocompatibility.

One embodiment further provides a method for producing a pump housing for a pump device, comprising the steps of:

a. providing a first material;
b. providing a further material;
c. providing a third material;
d. forming a pump housing precursor, wherein a first part-region of the pump housing is formed from the first material and wherein at least two further part-regions of the pump housing are formed from the further material and wherein at least one third part-region of the pump housing is formed from the third material;
e. treating the pump housing precursor at a temperature of at least 300° C.

The providing of the first material in step a., of the further material in step b. and of the third material in step c. can be effected in any desired manner that the person skilled in the art would select for this purpose.

The forming of the pump housing precursor in step d. can be effected in any desired manner that the person skilled in the art would select for the purpose of forming a first part-region and a further part-region.

In a preferred configuration of the method, step d. comprises a shaping process, preferably selected from the group consisting of a lithographic process, an injection molding, a machining, an extrusion or a combination of at least two of these.

In a lithographic process, various layers of one or more materials are introduced successively into a mold. The lithographic process preferably corresponds to a layered screen printing process. In a screen printing process, a screen consisting of a material of maximum dimensional stability, such as wood; metal, preferably steel; a ceramic or a plastic having a selected mesh size is placed onto or over the object to receive an overlay. The printing composition used for application or overlaying, for example in the form of a paste or a powder, is applied through a nozzle or from a vessel to this screen and forced through the meshes of the screen with a squeegee. On the basis of a pattern in the screen, printing composition used for application or overlaying can be applied in different amounts at different sites. For instance, by virtue of the geometry and arrangement of the meshes, it is possible to apply either a homogeneous film of the printing composition used for overlaying, or regions having less or no printing composition used for application alternating with regions having a large amount of printing composition used for application. Preferably, a homogeneous film of the printing composition used for overlaying is applied to the surface. The screen meshes may also be partly closed by to correspondingly applied materials (screen emulsions, screenprinting stencils), such that the printing composition is transferred onto the surface to be coated only in defined regions with open meshes, in order thus to obtain, for example, a defined structure such as a pattern. In addition, rather than screens, it is also possible to use thin films having defined openings (stencils) to transfer the printing composition. By repeating this operation with one and the same material or also different materials, it is possible to obtain 3D structures.

The injection molding, also called injection molding method, is a forming process for at least one material to obtain a formed solid body. The person skilled in the art is aware of different injection molding methods and of tools and conditions used in injection molding from the prior art. The injection molding may be selected from the group consisting of a multicomponent injection molding, a powder injection molding, an injection compression molding, an extrusion injection molding, a reduced pressure injection molding, or a combination of at least two of these.

The machining can be combined with any other shaping process. Machining involves structuring a solid body by use of machining aids such as a drill or a ram. In the structuring, a portion of the material is machined away. In this way, it is possible to form solid bodies, for example to give hollow bodies. For example, by machining into the pump housing precursor, it is possible to form a cavity when the pump housing precursor is solid. However, the machining may also be a processing step after the production of a pump housing or housing. In addition to the machining, polishing may also take place subsequently to the production of the pump housing.

In the forming of the pump housing precursor in step d., a first material for formation of a first part-region is contacted with a further material for formation of the further part-region and a third material for formation of a third part-region. The contacting preferably takes place in the form of an injection molding operation in which there is successive injection first of the further material into a metal mold and then of the first and third materials. Preferably, the further material is introduced into the mold in multiple steps. Further preferably, a first further material having a low content of ferromagnetic material is introduced in alternation with a second further material having a high content of ferromagnetic material. As already mentioned for the pump device of one embodiment, the first further material comprises the ferromagnetic material in a range from 20% to 100% by weight more than the second further material, based on the total weight of the second further material. The further components, for example the ceramic component of the first further and second further materials can likewise be inferred from the description for the pump device. Alternatingly forming the first further material and second further material preferably forms the at least two further part-regions of the pump housing precursor. The content of ferromagnetic material is found by averaging the content of the first further materials and the content of the second further mixture of ferromagnetic material. The first and second further materials, on treatment in step e., give rise to the sub-regions of the at least two further part-regions having different content of ferromagnetic material which have already been described for the pump device.

According to the configuration of the mold, it is also possible first to inject the third material into the mold, then the further material, for example in the form of layers of first further and second further material, and finally the first material. The ratios of first, further and third materials preferably correspond to the ratios in the first, further and third part-regions, as described above in connection with the first subject, the pump device of one embodiment. In addition, it is possible for the first, further and third materials to comprise additives. Preferably, the pump housing precursor, after the contacting, already has the shape of the pump housing. Preferably, the three materials form a continuous shape. The contacting may comprise another step or a plurality of further steps.

The additive selected may be any substance that the person skilled in the art would select as addition for the first material, the further material or the third material. The additive is preferably selected from the group consisting of water, a dispersant, a binder or a mixture of at least two of these.

The dispersant preferably comprises at least one organic substance. The organic substance preferably has at least one functional group. The functional group may be a hydrophobic or hydrophilic functional group. The functional group may be selected from the group consisting of an ammonium group, a carboxylate group, a sulfate group, a sulfonate group, an alcohol group, a polyalcohol group, an ether group or a mixture of at least two of these. The dispersant has functional groups preferably in a range from 1 to 100, or preferably in a range from 2 to 50, or preferably in a range from 2 to 30. Preferred dispersants are available under the trade names DISPERBYK® 60 from Byk-Chemie GmbH, and DOLAPIX CE 64 from Zschimmer & Schwarz GmbH & Co KG.

The binder is preferably selected from the group consisting of a methyl cellulose, a thermoplastic polymer, a thermoset polymer and a wax or a mixture of at least two of these.

The methyl cellulose is preferably selected from the group consisting of hydroxypropyl methyl cellulose (HPMC), hydroxyethyl methyl cellulose (HEMC), ethyl methyl cellulose (EMC) or a mixture of these. The methyl cellulose preferably comprises hydroxypropyl methyl cellulose (HPMC). Further preferably, the methyl cellulose comprises hydroxypropyl methyl cellulose in a range from 80 to 100% by weight, or preferably in a range from 90 to 100% by weight, or preferably in a range from 95 to 100% by weight, based on the total weight of methyl cellulose. Preferably, the methyl cellulose has a proportion of —$OCH_3$ groups in a range from 20% to 40% by weight, or preferably in a range from 23% to 37% by weight, or preferably in a range from 25% to 35% by weight, based on the total weight of methyl cellulose. Further preferably, the methyl cellulose has a proportion of —$OC_3H_6OH$ groups in a range from 1% to 12% by weight, or preferably in a range from 3% to 9% by weight, or preferably in a range from 4% to 8% by weight, based on the total weight of methyl cellulose.

The thermoplastic polymer may be selected from the group consisting of acrylonitrile butadiene-styrene (ABS), polyamides (PA), polylactate (PLA), polymethylmethacrylate (PMMA), polycarbonate (PC), polyethylene terephthalate (PET), polyethylene (PE), polypropylene (PP), polystyrene (PS), polyether ether ketone (PEEK) and polyvinyl chloride (PVC) or a mixture of at least two of these. The thermoset polymer may be selected from the group consisting of an aminoplast, an epoxy resin, a phenolic resin, a polyester resin or a mixture of at least two of these. Waxes are hydrocarbons that melt without decomposition above 40° C. These may also include polyesters, paraffins, polyethylenes or copolymers of at least two of these.

The first material for the at least one first part-region comprises at least one of the aforementioned additives preferably in a range from 0.1% to 10% by weight, or preferably in a range from 0.2% to 8% by weight, or preferably in a range from 0.5% to 5% by weight, based on the total weight of the first material.

The further material for the at least two further part-regions comprises at least one of the aforementioned additives preferably in an amount in a range from 0.1% to 5% by weight, or preferably in a range from 0.2% to 2% by weight, or preferably in a range from 0.3% to 1% by weight, based in each case on the total weight of the further material.

The third material for the at least one third part-region comprises at least one of the aforementioned additives preferably in a range from 0.1% to 10% by weight, or preferably in a range from 0.2% to 8% by weight, or preferably in a range from 0.5% to 5% by weight, based on the total weight of the third material.

The treatment of the pump housing precursor in step e. can be effected in any desired manner that the person skilled in the art would select for the purpose of heating the pump housing precursor to at least 300° C. Preferably, at least part of the treatment of the pump housing precursor takes place at a temperature in a range from 300 to 2500° C., or in a range from 500 to 2000° C., or in a range from 700 to 1800° C. In the treatment of the pump housing precursor at elevated temperature, preferably at least a portion of the binder escapes. Various temperature profiles are possible in the treatment in step e. of the pump housing precursor from step d. The treatment of the pump housing precursor can be effected, for example, in an oxidative atmosphere or a reductive atmosphere or under a protective atmosphere. An oxidative atmosphere may comprise oxygen, for example, such as air or an oxygen/air mixture. A reductive atmosphere may comprise hydrogen, for example. A protective atmosphere preferably comprises neither oxygen or hydrogen. Examples of protective atmospheres are nitrogen, helium, argon, krypton or mixtures thereof. The choice of atmosphere may be dependent on the materials to be treated. The person skilled in the art is aware of the suitable choice of atmosphere for the materials mentioned. It is also possible with preference, to successively choose combinations of different atmospheres for various periods of time.

The treatment of the pump housing precursor in step e. can either be effected in one step or preferably in more than one step. Preferably, the pump housing precursor, in a first sub-step of step e., is treated to a temperature in a range from 301 to 600° C., or preferably in a range from 350 to 550° C., or preferably in a range from 400 to 500° C. This first sub-step of treatment step e. can be effected over a period in a range from 1 to 180 min, preferably in a range from 10 to 120 min, or preferably in a range from 20 to 100 min. This sub-step can be effected either by introducing the pump housing precursor from step d. into a preheated atmosphere or by gradual stepwise or constantly increased heating of the pump housing precursor. Preferably, the treatment in the first sub-step of step e. of the pump housing precursor is undertaken in one step to a temperature in a range from 301 to 600° C.

In a second sub-step of the treatment from step e., which preferably follows on from the first sub-step, the pump housing precursor is preferably heated to a temperature in a range from 800 to 2500° C., or preferably in a range from 1000 to 2000° C., or preferably in a range from 1100 to 1800° C. This sub-step too can either be effected by introducing the pump housing precursor from the first sub-step of step e. into a preheated atmosphere or by gradual stepwise or constantly increased heating of the pump housing precursor. Preferably, the treatment in the second sub-step of step e. of the pump housing precursor is undertaken in one step to a temperature in a range from 800 to 2500° C. The treatment of the pump housing precursor in the second sub-step of step e. is preferably undertaken over a period of time in a range from 1 to 180 min, preferably in a range from 10 to 120 min, or preferably in a range from 20 to 100 min.

The shape of the pump housing after the production process is preferably continuous. This means that the pump housing, aside from the outlet and the inlet, has no further openings or drains, or other recesses. Preferably, the pump housing has a linear outer surface. On the inner surface of the pump housing, the wall thicknesses may vary in at least one of the first or further part-regions. An increase in the wall thickness at at least one point in the pump housing may serve to keep the impeller in its position in the pump housing at least in one direction. The increase in the wall thickness may take place either as early as during the production process or thereafter. Additionally or alternatively, the pump housing may have constrictions.

A pump device of one embodiment is obtainable by inserting an impeller into a pump housing, arranging electromagnets with coils around the pump housing, establishing an electric circuit including a control device and a power source, for example a battery. Preferably, the pump device of one embodiment is surrounded by a component housing, and the third part-regions of the pump housing are cohesively bonded to the component housing. This can be conducted, for example, by a solder bond along the contact point of pump housing and component housing.

One embodiment further provides a pump housing for a pump device, obtainable by the above-described method of one embodiment.

One embodiment further provides a housing comprising a wall surrounding an interior, wherein the housing has an inlet and an outlet, wherein the housing has at least one first part-region, at least two further part-regions and at least one third part-region;

wherein the wall of the housing, in at least one plane (Q) perpendicular to the longitudinal extent of the housing, has at least one first part-region and at least one further part-region;

wherein the at least one first part-region comprises, to an extent of at least 60% by weight, based on the total weight of the at least one first part-region, at least one nonmagnetic material, wherein the at least two further part-regions comprise, to an extent of at least 25% by weight, or preferably to an extent of at least 40% by weight, or preferably to an extent of at least 60% by weight, based on the total weight of the at least two further part-regions, at least one ferromagnetic material, wherein the at least one third part-region comprises a metal content in a range from 40% to 90% by weight, based on the total weight of the third part-region, wherein the at least one first part-region and at least one of the at least two further part-regions are cohesively bonded to one another.

The housing corresponds, in terms of its shape, its composition and the rest of its configuration, to the pump housing which has already been described above in the context of the pump device of one embodiment.

In a preferred configuration of the housing of one embodiment, the at least one first part-region and/or at least one of the at least two further part-regions is cohesively bonded to at least one third part-region. Preferably, at least one first part-region is cohesively bonded to two further part-regions. Further preferably, at least one first part-region is cohesively bonded to all further part-regions. It is additionally preferable that the at least one first part-region is cohesively bonded to at least one third part-region. Preferably, the at least one first part-region is cohesively bonded to two, or preferably to all, third part-regions.

In a preferred configuration of the housing a shiftable element is provided in the housing, at least in part of the housing. Further preferred embodiments of the housing correspond to the above-described embodiments of the pump device of one embodiment.

The shiftable element may be selected from the group consisting of a sphere, a cylinder, an air bubble or a combination of at least two of these. The shiftable element preferably has a shape corresponding to the diameter of the pump housing. The material of the shiftable element may be any that the person skilled in the art would use for the purpose. Preferably, the shiftable element comprises a metal, a polymer, a ceramic or a mixture of these. The metal or the polymer may be selected from a metal, a polymer or a ceramic as described for the first part-region for the pump housing. The shiftable element may serve to be moved within the housing in terms of its position, for example as a result of a change in the fluid flow in the housing. In the event of a change in the position of the shiftable element, a current flow in a coil may be triggered and recorded by means of a current flow meter.

One embodiment further provides a pump device comprising at least one above-described housing or a pump housing obtainable by the method described above.

Test Methods

1. Determination of Vickers hardness (HV):
   The test forces and materials were determined in accordance with the standard of DIN EN ISO 6507-March 2006. The following test forces and contact times were used: 1 kg, 15 seconds. The test temperature was 23° C.±1° C.
2. Determination of magnetic permeability: Magnetic permeability was determined in accordance with standard ASTM A773/A773-01(2009).
3. Determination of biocompatibility:
   Biocompatibility is determined in accordance with the standard of 10993-4:2002.
4. Determination of hermetic bonding:
   Leak tests are conducted with helium leak testers and/or mass spectrometers. A standard test method is specified in the standard Mil-STD-883G Method 1014. The maximum permissible helium leak rate is fixed as a function of the internal volume of the device to be tested. According to the methods specified in MIL-STD-883G, Method 1014, in paragraph 3.1, and taking account of the volumes and cavities of the devices to be tested that occur in the application of one embodiment, the maximum permissible helium leak rate for the pump housings of one embodiment is $10^{-7}$ atm*cm$^3$/sec or less. This means that the device to be tested (for example the component housing and/or the pump device or the component housing with the associated pump housing) has a helium leak rate of less than $1\times10^{-7}$ atm*cm$^3$/sec. For comparative purposes, the helium leak rates mentioned can also be converted to the equivalent standard air leak rate. The definition of the equivalent standard air leak rate and the conversion are specified in standard ISO 3530. Air leak rate=0.37 times helium leak rate.
5. Determination of roughness: DIN EN ISO 4288. Further parameters reported: maximum probe tip radius=2 μm; measurement distance=1.25 mm; threshold wavelength=250 μm.
6. Determination of the resistance between two first sub-regions or layers:
   To determine the resistance, a cross section through a test specimen is made, such that the layers to be analyzed are exposed. The section surface is cleaned in order to rule out current bridges resulting from particles that have been ground away. Each contact from a voltmeter (Benning MM 1-1) is pressed onto a notch in the layers to be analyzed and the resistance is read off. This is repeated 10 times and the mean of the measurements is formed.

EXAMPLES

Example 1 for First Material

The first material contains 45% by weight of platinum powder from Heraeus Precious Metals GmbH & Co.

KG having a grain size $D_{50}$=50 μm and 45% by weight of aluminum oxide ($Al_2O_3$) from CeramTech GmbH with a grain size of $D_{90}$=2 μm and 10% by weight of METAWAX P-50 binder, available from Zschimmer & Schwarz GmbH & Co. KG.

Example 2 for Further Material

The further material contains a mixture of 45% by weight of a Pt—Co-23 material from Heraeus Holding GmbH and 45% by weight of aluminum oxide ($Al_2O_3$), available from CeramTech GmbH, and 10% by weight of METAWAX P-50 binder, available from Zschimmer & Schwarz GmbH & Co. KG.

Example 3 for Third Material

The third material contains a mixture of 57% by weight of a platinum powder from Heraeus Precious Metals GmbH & Co. KG having a grain size $D_{50}$=50 μm, and 38% by weight of aluminum oxide ($Al_2O_3$) from CeramTech GmbH having a grain size of $D_{90}$=2 μm and 5% by weight of METAWAX P-50 binder, available from Zschimmer & Schwarz GmbH & Co.KG.

Example 4 for First Part-region

The first part-region contains 50% by weight of platinum powder from Heraeus Precious Metals GmbH & Co. KG and 50% by weight of aluminum oxide ($Al_2O_3$) from CeramTech GmbH.

Example 5 for Further Part-region

The further part-region contains 50 alternating layers, each composed of 60% by weight of a Pt—Co-23 material from Heraeus Holding GmbH and of 40% by weight of aluminum oxide ($Al_2O_3$), available from CeramTech GmbH, for all even-numbered layers. The odd-numbered layers consist of 100% by weight of aluminum oxide ($Al_2O_3$), available from CeramTech GmbH. The even-numbered layers accordingly correspond to the first sub-regions of the part-region and the odd-numbered layers to the second sub-regions of the part-region. The layers in this example are 100 μm thick. The further part-regions in this example include the ferromagnetic material, on average, to an extent of at least 25% by weight, based on the total amount of the respective further part-regions.

Example 6 for Third Part-region

The third part-region contains platinum to an extent of 60% by weight and aluminum oxide ($Al_2O_3$) from CeramTech GmbH to an extent of 40% by weight.

If unspecified here, the grain sizes of the materials can be taken from the product data sheet which is available from the raw material supplier and is often supplied with an order.

Figure 5:
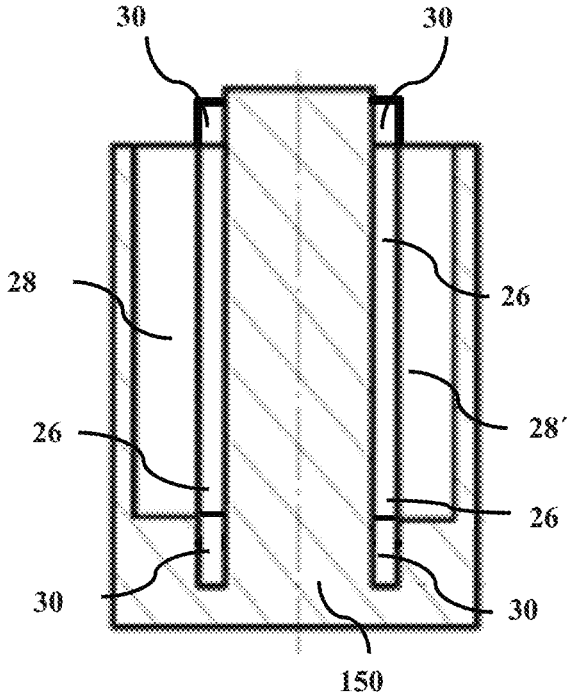
FIG. 5 is a scheme of a press device for production of a pump housing precursor without a ram.
Figure 6:
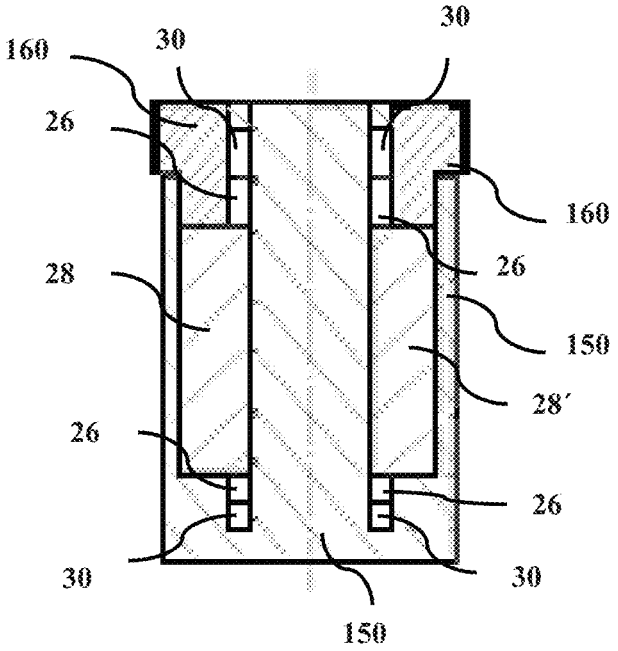
FIG. 6 is a scheme of a press device for production of a pump housing precursor with a ram.

The first material from example 1 is first provided in a vessel in accordance with the process of one embodiment for the production of a pump housing. The further material from example 2 is likewise provided in a vessel. The third material from example 3 is likewise provided in a vessel. In an alternating sequence, the powders of the third material, the further material and the first material can be introduced into the mold as shown in FIG. 5 and compressed with a ram as shown in FIG. 6. In this way, a pump housing precursor is obtained, which is first treated in an oven at a temperature of 400° C. and then sintered at a temperature of 1700° C. in order to obtain a pump housing having at least one first part-region having the composition according to example 4, at least two further part-regions having the composition from example 5 and at least one third part-region having the composition from example 6.

FIG. 1 shows, in schematic form, a pump device 10 having a pump housing 20 in the form of a tube, and a component housing 40. Epsecially, in an implantable pump device 10 the outer surfaces 100 of the component housing 40 come into contact with the body, and therefore preferably have a biocompatible configuration. The pump housing 20 has a wall 21 surrounding an interior 50. The surface of the pump housing 20 pointing towards the interior 50 is referred to as facing surface 102. The facing surface 102 comes into contact with the fluid and therefore preferably has a biocompatible configuration, especially for an implantable pump device 10. Disposed in the interior 50 of the pump housing 20 is at least one impeller 80 in the pump housing 20. The pump housing 20 has a first part-region 26 in the middle of the wall 21. At the first end 22, which simultaneously defines the inlet 22 through the opening 23, the wall 21 or the pump housing 20 has a first third part-region 30. At the opposite end of the pump housing 20 is the further end 24, in the form of the outlet 25 comprising the further opening 25. Likewise adjoining this opening 25 is a third part-region 30. Adjoining the first part-region 26, two further part-regions 28 and 28' project upward and downward away from the tube. By means of the impeller 80, it is possible to pump a fluid in pump direction 240 from the inlet 22 to the outlet 24. Between the component housing 40 and the pump housing 20 are further components, such as a battery 120 and a control unit 130. In addition, there are two coils 32 and 32' in the component housing 40. The coils 32 and 32' may either be arranged around the at least two further part-regions 28, 28' or be present elsewhere in the component housing 40. The further part-regions 28, 28' are configured as protuberances from the otherwise tubular pump housing 20.

Figure 2A:
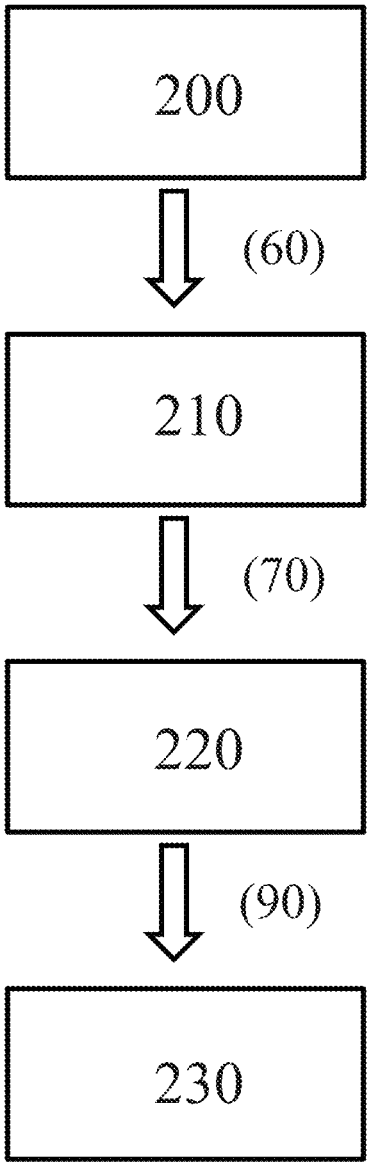
FIG. 2 is a scheme of a method for producing a pump housing of one embodiment.
Figure 2B:
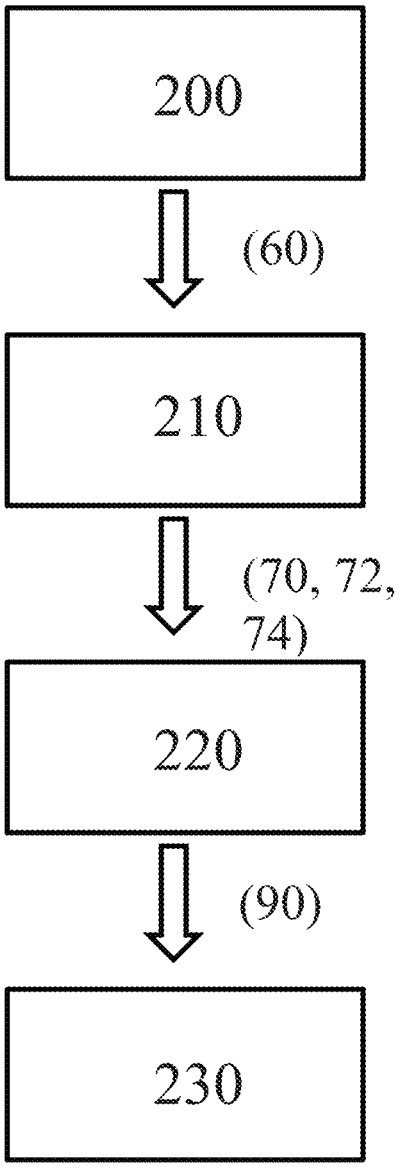

FIGS. 2*a* and 2*b* show, in schematic form, the process procedure for production of a pump housing. In step a. 200, a first material 60 is provided. The first material 60 is, for example, a mixture of at least two powders. The first material preferably contains the composition from example 1.

The further material 70 is provided, for example, in the form of a mixture from example 2 in step b. 210, as shown in FIG. 2*a*. Alternatively, as shown in FIG. 2*b*, the further material 70 may also be provided in the form of two different mixtures, wherein a first further material 72 contains the ferromagnetic material in the form of Pt—Co-23 powder to an extent of 90% by weight and the binder METAWAX P-50 to an extent of 10% by weight. The second further material 74 comprises 90% by weight of aluminum oxide ($Al_2O_3$) powder and 10% by weight of the binder METAWAX P-50. The two mixtures, i.e. the first further material 72 and the second further material 74, in this alternative, are formed alternately in equal amounts to give the further part-region 28, 28'.

The materials 70, 72 and 74 are introduced via vessels into a mold. The vessel may in each case be a metal vessel having a sieve outlet. Preferably, the powder grains have a round to oval extent. The particle size figure $D_{50}$ means that not more than 50% of the particles are larger than the diameter specified. The particle size figure $D_{90}$ means that not more than 90% of the particles are larger than the diameter specified. The particle size can be determined by various methods. The particle size is preferably determined with the aid of laser diffraction, light microscopy, optical individual particle counting or a combination of at least two of these. Further preferably, the determination of the particle size and the particle size distribution is undertaken with the aid of optical individual evaluation of images by means of transmission electron microscopy (TEM).

The third material 75 is provided in the form of a mixture from example 3 in step c. 220. The vessel here too may be a metal vessel having a sieve outlet.

In a step d. 230, the first material 60, the further material 70 and the third material 75 are used to form a pump housing precursor 90.

Step d. 230 can be effected by two alternative routes for formation of the pump housing precursor 90. In the first alternative of step d., first of all, a further part-region 28 is formed by the further material 70, or the first further material in alternation with the second further material. In this case, the further material 70 is, or the first further material and the second further material in alternation are, pressed into a first mold made of aluminum oxide ceramic, with the aid of a Teflon doctor blade having dimensions 10 mm*4 mm*2 mm and a doctor blade hardness of 50 Shore. The first mold is open on one side. Subsequently or simultaneously, the first material 60 is pressed into a further mold and the third material 75 into a third mold as described for the further material. The further mold and the third mold are also open on one side. A stainless steel ram is used to compress the first material 60, the third material 75 and the further material 70 under a pressure from a weight of 10 kg. This results in three blanks, which are treated at a temperature of 400° C. in a furnace from Heraeus Holding GmbH for 10 hours.

Subsequently, the three blanks are combined to form a pump housing precursor 90 at the open sides of the mold. The pump housing precursor is treated under air at a temperature of 400° C. This treatment takes place in a furnace from Heraeus Holding GmbH for a period of 160 min. Directly after this treatment step, the pump housing precursor 90 is treated at a temperature of 1700° C. in the same oven for 180 min, in the course of which the part-regions 30 sinter together with 26, and 26 together with 28, giving rise to a pump housing. A pump housing is formed in the form of a round tube composed of at least one first part-region and at least one third part-region and protuberances of at least two further part-regions. The internal diameter of the pump housing is, for example, 9 mm.

In the second alternative of step d., the part-regions 30, 26 and 28, 28' are formed together in a mold 150 as shown in FIG. 5. First of all, for this purpose, the material 75 for a third part-region 30 is introduced into the mold, then the material 60 for a first part-region 26 is introduced into the mold. On top of this first part-region 26, material 70, for example in the form of the first further material 72 is introduced into the mold in alternation with the second further material 74, for two or more further part-regions 28, 28'. This is then followed by a first part-region 26 composed of material 60 and a third part-region 30 composed of material 75. Subsequently, a lid or ram 160 made of stainless steel is pressed onto the mold 150, in order to compress the part-regions together, as shown in FIG. 6. In this case, a weight of 10 kg is pressed onto the part-regions. Subsequently, the part-regions 26, 28, 28'and 30 are heated together to 400° C. in the mold in a furnace from Heraeus Holding GmbH, initially for 160 min. Directly after this treatment step, the pump housing precursor 90 is treated in the same furnace at a temperature of 1700° C. for 180 min, in the course of which the part-regions 30 sinter together with 26, and 26 together with 28, forming a pump housing. A pump housing is formed in the form of a round tube composed of at least one first part-region and two third part-regions, and protuberances from the tube composed of at least two further part-regions. The internal diameter of the pump housing is, for example, 9 mm.

Figure 3A:
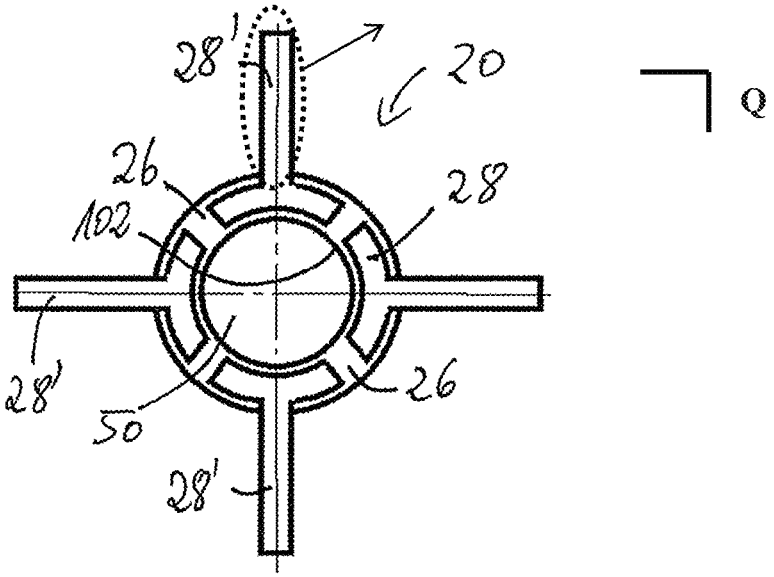
FIG. 3*a* is a schematic diagram of a pump housing of one embodiment with one first and several further part-regions arranged adjacent to one another.

FIG. 3*a* shows a cross section (in a plane Q) through a pump housing 20 produced as above. The core of the tubular pump housing 20 is formed by a first part-region 26, into which four further part-regions 28 and 28' project. The further part-regions 28 and 28' form protuberances from the pump housing 20 in all four points of the compass, in the form of a star. If the further part-regions have been formed in the form of layers of a first further material 72 and a second further material 74, the layers are preferably formed alternately, viewed from the middle of the tube, predominantly along the alignment of the protuberances 28, 28'. An example of one of the protuberances 28, 28' with preferred alignment with respect to the interior 50 is shown in FIG. 3*c*. Preferably, the protuberances 28, 28' point radially outward from the middle of the tube 50. The surface of the interior 50, consequently the surface 102 facing the interior 50, in this embodiment, is formed exclusively by a first part-region 26 and optionally one or two third part-regions (not shown here).

Figure 3B:
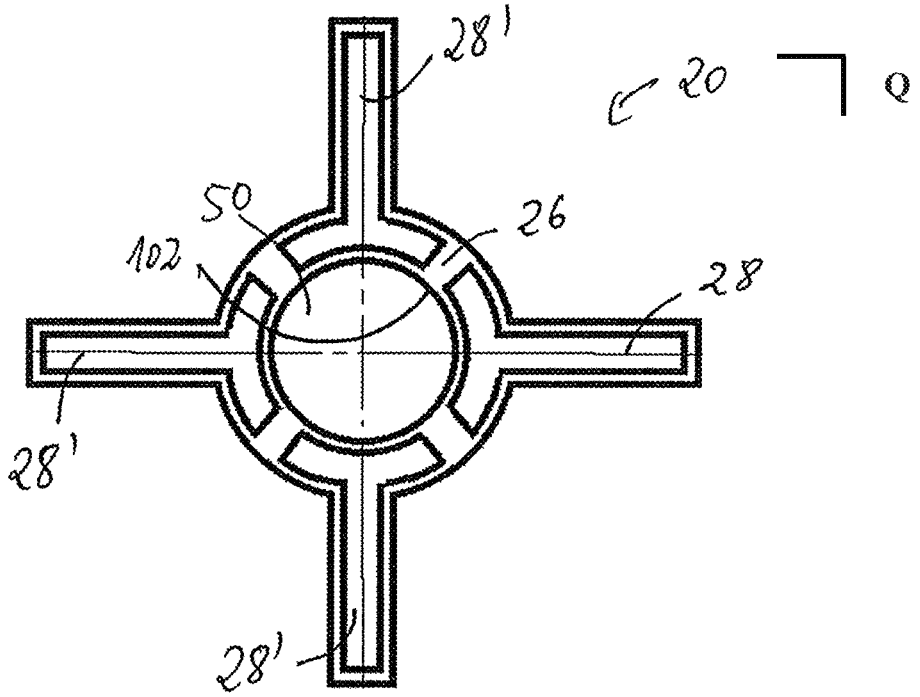
FIG. 3*b* is a schematic diagram of a pump housing of one embodiment having one first and several further part-regions, wherein the first part-region encloses the further part-regions.
Figure 3C:
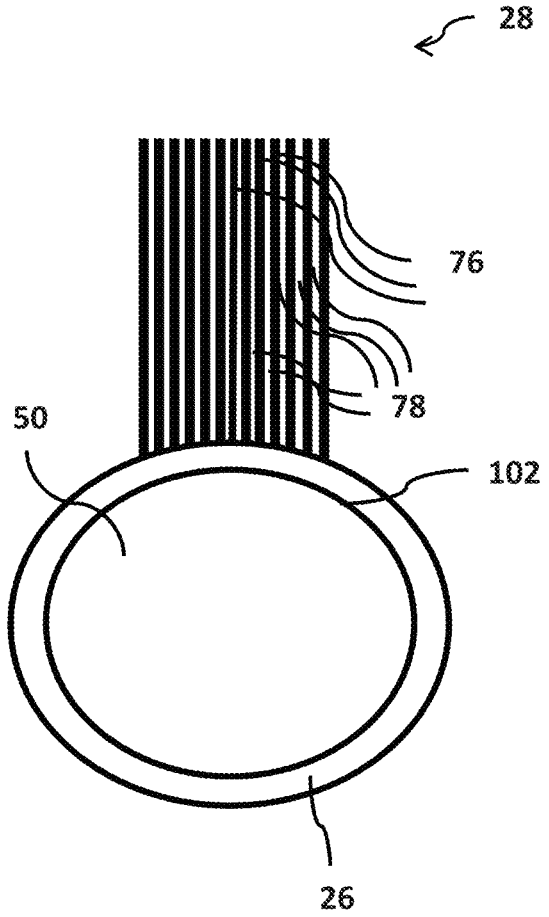
FIG. 3*c* is a schematic diagram of a pump housing of one embodiment having one first and several further part-regions, wherein the part-regions take the form of an alternating layer sequence.

FIG. 3*b* likewise shows a cross section (in the plane Q) through a pump housing 20 of one embodiment. The arrangements of the further part-regions 28 and 28' are identical to those from FIG. 3*a* and project outward in all four directions of the compass away from the tubular base body of the pump housing. Unlike the further part-regions 28, 28', the further part-regions 28, 28' in the embodiment from FIG. 3*b* are surrounded by the first part-region 26. The result of this is that the entire outer surface of the pump housing 20 comprises the first part-region 26, and optionally one or two third part-regions (not shown here) at the inlet and outlet.

FIG. 3*c* shows an example of one possible configuration of the protuberances 28, 28' and hence also of the first sub-regions 76 and the further sub-regions 78 of the further part-regions 28, 28'. The part-regions 28, 28' point radially away from the interior 50 of the tubular pump housing 20. The first sub-regions 76 and second sub-regions 78 of the respective protuberance 28, 28' extend alternately in parallel with the radial alignment of the part-regions 28, 28'. The first sub-regions 76 and the further sub-regions 78 are arranged one on top of another in layers in the protuberance 28 pointing upward. In this example, 13 first sub-regions 76 alternate with 12 second sub-regions 78. The thickness of the first sub-regions 76 and the further sub-regions 78 may vary from 1 to 1000 μm. In this example, the thickness of all sub-regions is 100 μm. Preferably, all protuberances on the pump housing 20 have the same geometry and same arrangement of first sub-regions 76 and further sub-regions 78.

Figure 4A:
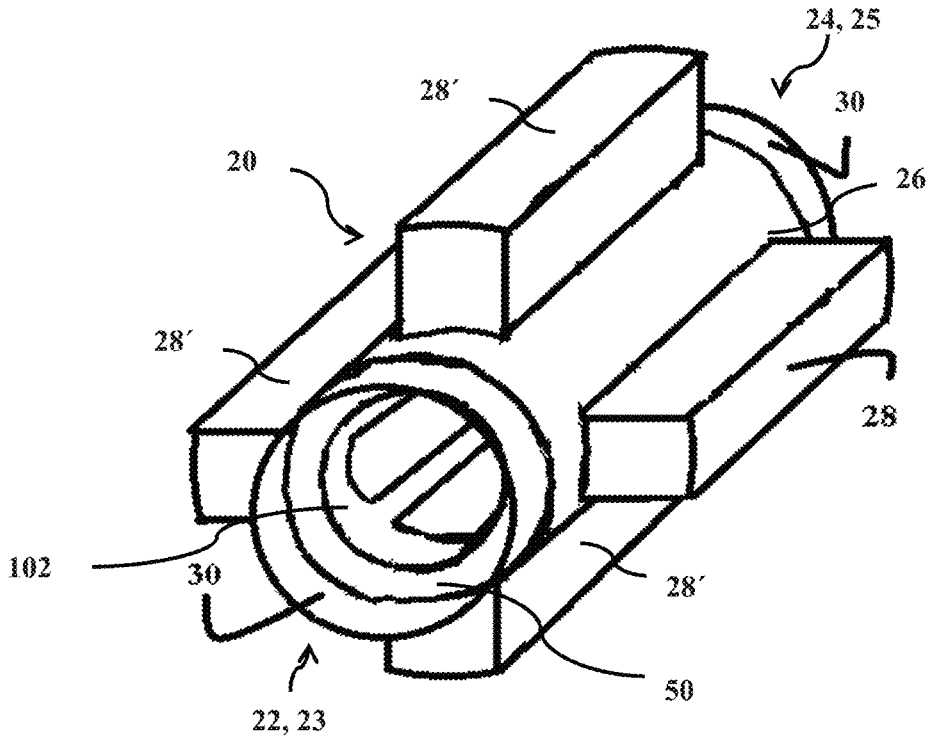
FIG. 4*a* is a schematic diagram of a pump housing of one embodiment having one first and several further part-regions, wherein two third part-regions are arranged adjacent to the first part-region.

FIG. 4*a* again shows a pump housing 20 having protuberances composed of further part-regions 28, 28' from the tubular base body of the pump housing 20. Here, the further part-regions 28 and 28' all project through the wall thickness of the pump housing 20 through to the interior 50. The interior 50 consequently has, on its facing surface 102, both portions of a first part-region 26 and a third part-region 30, and portions of further part-regions 28, 28'. The third part-regions 30 project at the inlet 22 and the outlet 24 beyond the first part-region 26 up to the openings. The third part-regions 30 are in direct contact only with the first part-region 26.

Figure 4B:
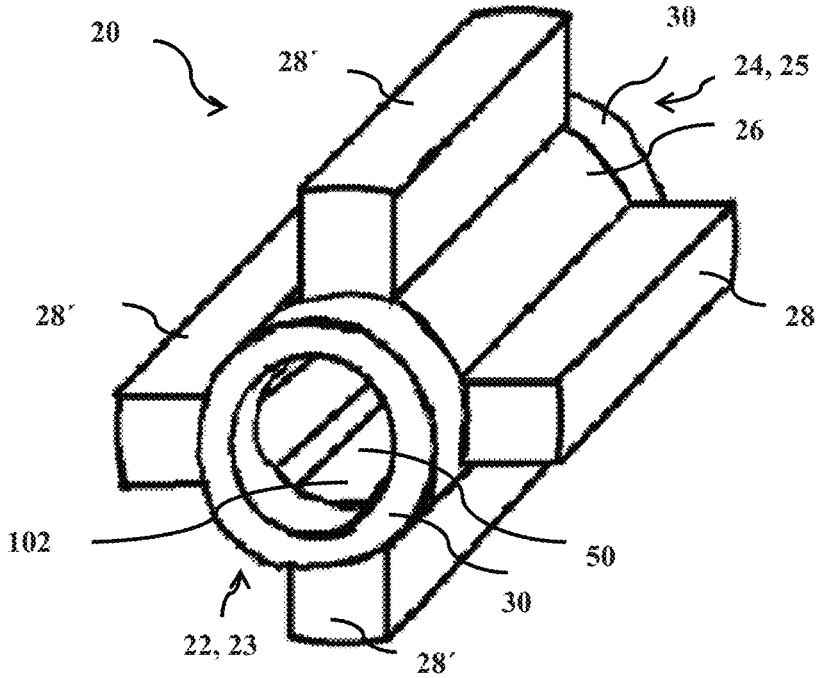
FIG. 4*b* is a schematic diagram of a pump housing of one embodiment having several first and several further part-regions arranged adjacent to two third part-regions.

The embodiment from FIG. 4*b* has the same shape and arrangement of the first 26 and further part-regions 28, 28', with the difference that the further part-regions 28 and 28', in the longitudinal extent of the pump housing 20, extend up to the third part-regions 30. The consequence of this is that, in the region of the first opening 23 of the inlet 22 and in the region of the further opening 25 of the outlet 24, the three different part-regions are in contact with one another in the form of a third part-region 30, four further part-regions 28, 28' and four first part-regions 26.

FIG. 5 shows a mold 150 after it has been filled, as already described above, by the materials 60, 70 and 75 for the first part-regions 26, the further part-regions 28, 28' and the third part-regions 30. The mold 150 may, for example, be a mold made of ceramic, such as $Al_2O_3$.

FIG. 6 shows the mold 150 from FIG. 5, closed by a lid 160. The lid 160 may be manufactured, for example, from stainless steel.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A pump device comprising:

an impeller;

a pump housing comprising a wall surrounding an interior having an inlet and an outlet, wherein the inlet and the outlet of the pump housing are axially aligned;

wherein the impeller is provided in the interior of the pump housing;

wherein the pump housing comprises at least one first part-region, at least two further part-regions and at least one third part-region;

wherein the at least one first part-region comprises, to an extent of at least 60% by weight, based on the total weight of the at least one first part-region, at least one nonmagnetic material, wherein the at least two further part-regions each comprise, to an extent of at least 25% by weight, based on the total weight of the respective further part-region, at least one ferromagnetic material;

wherein the at least one third part-region comprises a metal content in a range from 40% to 90% by weight, based on the total weight of the at least one third part-region;

wherein the wall of the pump housing, in at least one plane (Q) perpendicular to the longitudinal extent of the pump housing, has the at least one first part-region and the at least two further part-regions;

wherein the at least one first part-region and at least one of the at least two further part-regions are cohesively bonded to one another and wherein the at least one nonmagnetic material of the at least one first part-region comprises a nonmagnetic metal in a range from 60% to 90% by weight, based on the total weight of the at least one first part-region.

2. The pump device as claimed in claim 1, wherein the at least one third part-region comprises, to an extent of at least 60% by weight, based on the total weight of the at least one third part-region, the at least one nonmagnetic material.

3. The pump device of claim 1, wherein the pump housing comprises a tube.

4. The pump device of claim 1, wherein the at least one third part-region is provided at the inlet or the outlet, or wherein one third part-region each is provided at the inlet and the outlet.

5. The pump device of claim 1, wherein the at least two further part-regions each comprise at least one first sub-region and each comprise a second sub-region, wherein the at least one first sub-region comprises more ferromagnetic material than the second sub-region.

6. The pump device of claim 5, wherein the at least one first sub-region and the second sub-region are configured in the form of a layer.

7. The pump device of claim 1, wherein the pump housing has a volume in a range from 0.1 $cm^3$ to 10 $cm^3$.

8. The pump device of claim 1, wherein at least part of every one of the at least two further part-region is surrounded by at least one electrical coil each.

9. The pump device of claim 2, wherein the at least one nonmagnetic material of the at least one first part-region or the at least one third part-region is selected from the group consisting of a cermet, aluminum oxide (Al2O3), zirconium dioxide (ZrO2), a zirconium oxide containing an aluminum oxide (ATZ), an aluminum oxide containing a zirconium oxide (ZTA), an yttrium-containing zirconium oxide (Y-TZP), aluminum nitride (AlN), magnesium oxide (MgO), a piezoceramic, barium (Zr, Ti) oxide, barium (Ce, Ti) oxide and sodium potassium niobate, a platinum alloy, a palladium alloy, a titanium alloy, a niobium alloy, a tantalum alloy, a molybdenum alloy, a stainless steel (AISI 304, AISI 316 L) or a mixture of at least two of the materials from the group.

10. The pump device of claim 1, wherein the at least one ferromagnetic material of at least one of the at least two further part-regions is selected from the group consisting of iron, (Fe), cobalt (Co), nickel (Ni), chromium dioxide (CrO2), ferrite (Fe2O3), an iron alloy, an iron-nickel alloy, an iron-silicon alloy, an iron-cobalt alloy, a nickel alloy, an aluminum-nickel alloy, a cobalt alloy, a cobalt-platinum alloy, a cobalt-chromium alloy, a neodymium-iron-boron alloy, a samarium-cobalt alloy or a mixture of at least two of the materials from the group.

11. The pump device of claim 1, wherein at least one of the at least two further part-regions further comprises a component selected from a ceramic, or a further metal or a mixture of these.

12. The pump device of claim 11, wherein the further metal in at least one of the at least two further part-regions is selected from the group consisting of platinum (Pt), palladium (Pd), iridium (Ir), niobium (Nb), molybdenum (Mo), tungsten (W), titanium (Ti), chromium (Cr), a cobalt-chromium alloy, tantalum (Ta) and zirconium (Zr) or a mixture of at least two of the metals from the group.

13. The pump device of claim 1, wherein the at least one first part-region and/or at least one of the at least two further part-regions is cohesively bonded to the at least one third part-region.

14. The pump device of claim 1, wherein the pump device is at least partly surrounded by a component housing, wherein at least part of the at least one third part-region of the pump device is bonded to the component housing.

15. The pump device of claim 14, wherein the component housing comprises at least 30% by weight, based on the total weight of the component housing, of titanium.

16. The pump device of claim 1, wherein the wall of the pump housing has a magnetic permeability of less than 2 μ.

17. The pump device of claim 1, wherein a surface of the wall facing the interior of the pump housing has a Vickers hardness of at least 330 HV.

18. The pump device of claim 1, wherein a surface of the wall facing the interior of the pump housing has a Vickers hardness at least 20 HV higher than a surface of the impeller pointing towards the interior of the pump housing.

19. The pump device of claim 1, wherein at least the outer surfaces of a component housing and a surface facing the interior of the pump housing are biocompatible.

20. A method for producing a pump housing for a pump device comprising:

providing a first material;

providing a further material;

providing a third material;

forming a pump housing precursor, wherein a first part-region of the pump housing is formed from the first material and wherein at least two further part-regions of the pump housing are formed from the further material and wherein at least one third part-region of the pump housing is formed from the third material; and treating the pump housing precursor at a temperature of at least 300° C.

21. The method of claim 20, wherein forming a pump housing precursor comprises a shaping process selected from the group consisting of a lithographic process, an injection molding, a machining, an extrusion or a combination of at least two of the shaping processes from the group.

22. A housing comprising:

a wall surrounding an interior, wherein the housing has an inlet and an outlet that are axially aligned, wherein the housing has at least one first part-region, at least two further part-regions and at least one third part-region;

wherein the wall of the housing, in at least one plane (Q) perpendicular to the longitudinal extent of the housing, has the at least one first part-region and at least one of the at least two further part-regions;

wherein the at least one first part-region comprises, to an extent of at least 60% by weight, based on the total weight of the at least one first part-region, at least one nonmagnetic material, wherein the at least two further part-regions comprise, to an extent of at least 25% by weight, based on the total weight of the at least two further part-regions, at least one ferromagnetic material, wherein the at least one third part-region comprises a metal content in a range from 40% to 90% by weight, based on the total weight of the at least one third part-region, wherein the at least one first part-region and at least one of the at least two further part-regions are cohesively bonded to one another; and wherein the at least one nonmagnetic material of the at least one first part-region comprises a nonmagnetic metal in a range from 60% to 90% by weight, based on the total weight of the at least one first part-region.

23. The housing of claim 22, wherein the at least one first part-region and/or at least one of the at least two further part-regions is cohesively bonded to the at least one third part-region.

24. The housing of claim 22 configured within a pump device.

25. A pump device comprising:

an impeller;

a pump housing comprising a wall surrounding an interior having an inlet and an outlet, wherein the inlet and the outlet of the pump housing are axially aligned;

wherein the impeller is provided in the interior of the pump housing and a surface facing the interior of the pump housing is biocompatible;

wherein the pump housing comprises at least one first part-region, at least two further part-regions and at least one third part-region;

wherein the at least one first part-region comprises a nonmagnetic metal in a range from 40% to 90% by weight, based on the total weight of the at least one first part-region, wherein the at least two further part-regions each comprise, to an extent of at least 25% by weight, based on the total weight of the respective further part-region, at least one ferromagnetic material;

wherein the at least one third part-region comprises a metal content in a range from 40% to 90% by weight, based on the total weight of the at least one third part-region;

wherein the wall of the pump housing, in at least one plane (Q) perpendicular to the longitudinal extent of the pump housing, has the at least one first part-region and the at least two further part-regions; and wherein the at least one first part-region and at least one of the at least two further part-regions are cohesively bonded to one another and wherein the at least two further part-regions project into the at least one first part-region.

26. A housing comprising:

a wall surrounding an interior having a surface that is biocompatible, wherein the housing has an inlet and an outlet that are axially aligned, wherein the housing has at least one first part-region, at least two further part-regions and at least one third part-region;

wherein the wall of the housing, in at least one plane (Q) perpendicular to the longitudinal extent of the housing, has the at least one first part-region and at least one of the at least two further part-regions;

wherein the at least one first part-region comprises, to an extent of at least 60% by weight, based on the total weight of the at least one first part-region, at least one nonmagnetic material, wherein the at least two further part-regions comprise, to an extent of at least 25% by weight, based on the total weight of the at least two further part-regions, at least one ferromagnetic material, wherein the at least one third part-region comprises a metal content in a range from 40% to 90% by weight, based on the total weight of the at least one third part-region, wherein the at least one first part-region and at least one of the at least two further part-regions are cohesively bonded to one another and wherein the at least two further part-regions project into the at least one first part-region; and wherein at least one nonmagnetic material of the at least one first part-region comprises a nonmagnetic metal in a range from 60% to 90% by weight, based on the total weight of the at least one first part-region.

* * * * *